US010954716B2

(12) United States Patent
Anderson et al.

(10) Patent No.: US 10,954,716 B2
(45) Date of Patent: Mar. 23, 2021

(54) LIFT STATION FOR A COVERING FOR AN ARCHITECTURAL STRUCTURE

(71) Applicant: Hunter Douglas Inc., Pearl River, NY (US)

(72) Inventors: Richard N. Anderson, Whitesville, KY (US); Eugene W. Thompson, Maceo, KY (US)

(73) Assignee: Hunter Douglas Inc., Pearl River, NY (US)

( * ) Notice: Subject to any disclaimer, the term of this patent is extended or adjusted under 35 U.S.C. 154(b) by 284 days.

(21) Appl. No.: 16/128,028

(22) Filed: Sep. 11, 2018

(65) Prior Publication Data

US 2019/0085623 A1 Mar. 21, 2019

Related U.S. Application Data

(60) Provisional application No. 62/561,255, filed on Sep. 21, 2017.

(51) Int. Cl.

| | |
|---|---|
| ***E06B 9/322*** | (2006.01) |
| ***E06B 9/262*** | (2006.01) |
| ***E06B 9/388*** | (2006.01) |
| ***E06B 9/303*** | (2006.01) |
| ***E06B 9/326*** | (2006.01) |

(52) U.S. Cl.

CPC ..... *E06B 9/322* (2013.01); *E06B 9/262* (2013.01); *E06B 9/303* (2013.01); *E06B 9/326* (2013.01); *E06B 9/388* (2013.01); *E05Y 2201/47* (2013.01); *E05Y 2201/622* (2013.01)

(58) Field of Classification Search

None

See application file for complete search history.

(56) References Cited

U.S. PATENT DOCUMENTS

| | | | |
|---|---|---|---|
| 5,103,888 | A | 4/1992 | Nakamura |
| 5,515,898 | A | 5/1996 | Alcocer |
| 6,588,480 | B2 | 7/2003 | Anderson |
| 6,915,831 | B2 | 7/2005 | Anderson |

(Continued)

FOREIGN PATENT DOCUMENTS

| | | |
|---|---|---|
| EP | 1052365 | 12/2004 |
| EP | 1698756 | 9/2006 |

(Continued)

OTHER PUBLICATIONS

European Search Report issued in corresponding Application No. 18194888.6 dated Apr. 11, 2019 (10 pages).

*Primary Examiner* — Beth A Stephan

(74) *Attorney, Agent, or Firm* — Dority & Manning, P.A.

(57) ABSTRACT

In one aspect, a lift station configured for use with a covering for an architectural structure includes a housing and one or more lift spools disposed within a spool cavity defined by the housing. Additionally, the lift station also includes first and second outriggers extending outwardly from opposed sides of the housing of the lift station. The first outrigger is configured to define a first cord guide surface for guiding a front lift cord between a front side of the covering and the spool cavity of the housing. Similarly, the second outrigger is configured to define a second cord guide surface for guiding a rear lift cord between a rear side of the covering and the spool cavity of the housing.

20 Claims, 14 Drawing Sheets

(56) References Cited

U.S. PATENT DOCUMENTS

| | | | | |
|---|---|---|---|---|
| 6,981,539 | B2 | 1/2006 | Fraczek | |
| 7,093,644 | B2 | 8/2006 | Strand | |
| 7,464,742 | B2 | 12/2008 | Oskam et al. | |
| 8,708,023 | B2 | 4/2014 | Wu | |
| 8,807,194 | B2 | 8/2014 | Shun et al. | |
| 8,960,258 | B2 | 2/2015 | Hendriks et al. | |
| 9,121,221 | B2 | 9/2015 | Cheng | |
| 9,314,125 | B2 * | 4/2016 | Anthony | A47H 5/032 |
| 9,371,691 | B2 | 6/2016 | Yu et al. | |
| 9,422,766 | B2 * | 8/2016 | Anderson | E06B 9/90 |
| 9,670,723 | B2 | 6/2017 | Pham et al. | |
| 9,689,199 | B1 | 6/2017 | Chen | |
| 9,708,850 | B2 * | 7/2017 | Anderson | E06B 9/262 |
| 10,138,674 | B2 * | 11/2018 | Hsu | E06B 9/322 |
| 2002/0050539 | A1 | 5/2002 | Anderson | |
| 2002/0088562 | A1 * | 7/2002 | Palmer | E06B 9/90 160/170 |
| 2002/0157796 | A1 * | 10/2002 | Judkins | E06B 9/32 160/84.04 |
| 2007/0144686 | A1 | 6/2007 | Drew | |
| 2012/0267060 | A1 * | 10/2012 | Anderson | E06B 9/262 160/241 |
| 2013/0032300 | A1 | 2/2013 | Yu et al. | |
| 2016/0319594 | A1 | 11/2016 | Anderson et al. | |

FOREIGN PATENT DOCUMENTS

| | | |
|---|---|---|
| EP | 2405096 | 8/2013 |
| EP | 2986800 | 6/2017 |
| JP | 4488943 | 6/2010 |
| WO | WO 2014/171422 | 10/2014 |
| WO | WO 2014/181706 | 11/2014 |
| WO | WO 2016/084527 | 6/2016 |
| WO | WO 2016/117660 | 7/2016 |

* cited by examiner

LIFT STATION FOR A COVERING FOR AN ARCHITECTURAL STRUCTURE

CROSS-REFERENCE TO RELATED APPLICATIONS

The present application is based upon and claims priority to U.S. Provisional Patent Application No. 62/561,255, filed on Sep. 21, 2018, the disclosure of which is hereby incorporated by reference herein in its entirety for all purposes.

FIELD

The present subject matter relates generally to coverings for architectural structures, such as windows, and, more particularly, to an improved lift station for use with a covering, such as a "privacy" Venetian blind.

BACKGROUND

Coverings, such as horizontal/Venetian blinds and other similar blinds, typically include a headrail, a bottom rail, and a plurality of horizontally oriented slats configured to be supported between the headrail and the bottom rail via two or more sets of cord ladders. Additionally, one or more lift cords typically extend between the headrail and the bottom rail for adjusting the position of the bottom rail relative to the headrail. In many instances, each lift cord passes through a set of aligned route holes defined in the slats. Unfortunately, given their shape and typical dimensions, conventional route holes generally allow for light to pass through a blind when the slats have been tilted to their fully closed position. Additionally, the light gaps defined between the lift cord and the outer perimeter of conventional route holes often allow for a view through the blind when the blind is closed, thereby creating privacy concerns for homeowners with such blinds.

To address such light-blocking and privacy concerns, "privacy" Venetian blinds have been developed that eliminate the route holes from the slats and include lift cords that extend along the front and rear sides of the slats to allow the bottom rail to be raised and lowered relative to the headrail. However, when re-configuring the cord arrangement, the lifting hardware for the blind must be modified to accommodate the front and rear lift cords. To date, various lift station configurations have been developed to provide cord operation for "privacy" Venetian blinds. However, current lift stations suffer one or more drawbacks, including, but not limited to, size issues given space constraints within the rail, issues associated with routing the lift cords between the front and rear sides of the covering, tensioning issues with the cords, and/or various other issues.

Accordingly, an improved lift station configuration for accommodating front and rear lift cords for a covering, such as a "privacy" Venetian blind, would be welcomed in the technology.

BRIEF SUMMARY

Aspects and advantages of the present subject matter will be set forth in part in the following description, or may be obvious from the description, or may be learned through practice of the present subject matter.

In various aspects, the present subject matter is directed to a lift station configured for use with a covering for an architectural structure. Specifically, in one embodiment, the lift station includes a housing defining a spool cavity configured to receive one or more lift spools. Additionally, the lift station also includes first and second outriggers extending outwardly from opposed sides of the housing. The first outrigger is configured to define a first cord guide surface for guiding a front lift cord between a front side of the covering and the spool cavity. Similarly, the second outrigger is configured to define a second cord guide surface for guiding a rear lift cord between a rear side of the covering and the spool cavity.

Additionally, in various aspects, the present subject matter is also directed to a covering for an architectural structure that incorporates one or more of the lift stations described herein For example, in one embodiment, the covering includes a headrail, a bottom rail, and at least one covering element supported between the headrail and bottom rail. Additionally, the covering includes a front lift cord extending along a front side of the covering between the headrail and the bottom rail, and a rear lift cord extending along a rear side of the covering between the headrail and the bottom rail. In such an embodiment, the front and rear lift cords may be provided in operative association with a single lift station or a separate lift stations for winding and unwinding the cords as the bottom rail is raised and lowered, respectively, relative to the bottom rail. For example, in one embodiment, the lift station may be positioned within the bottom rail of the covering.

These and other features, aspects, and advantages of the present subject matter will become better understood with reference to the following Detailed Description and appended claims. The accompanying drawings, which are incorporated in and constitute a part of this specification, illustrate embodiments of the present subject matter and, together with the description, serve to explain the principles of the present subject matter.

This Brief Description is provided to introduce a selection of concepts in a simplified form that are further described below in the Detailed Description. This Brief Description is not intended to identify key features or essential features of the claimed subject matter, nor is it intended as an aid in determining the scope of the claimed subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION

Figure 1:
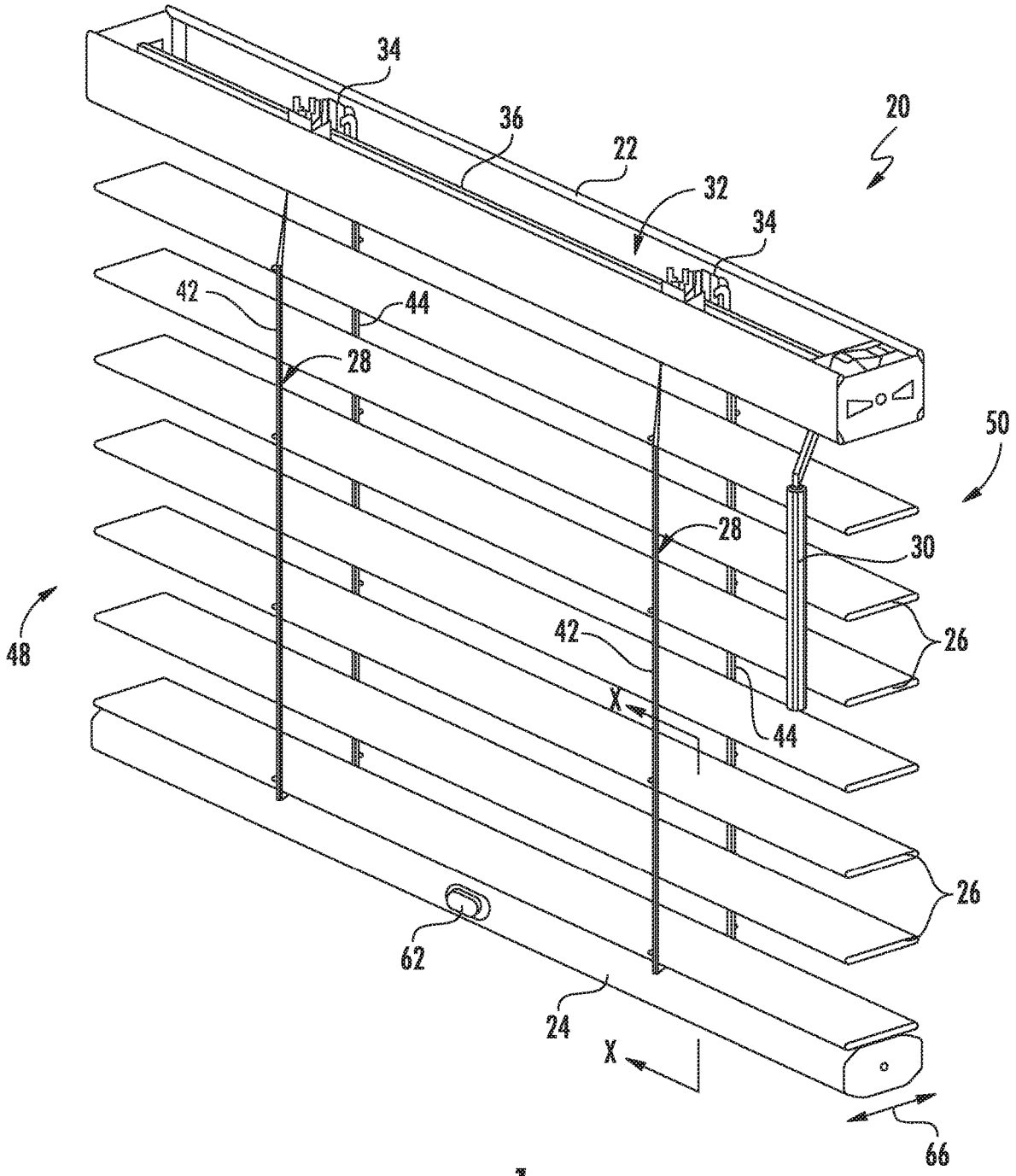
FIG. 1 illustrates a perspective view of one embodiment of a covering for an architectural structure in accordance with aspects of the present subject matter.

In general, the present subject matter is directed to an improved lift station configured for use with a covering for an architectural feature or structure (referred to herein simply as an architectural "structure" for the sake of convenience and without intent to limit). Specifically, in several embodiments, the lift station includes a housing and one or more lift spools disposed within a spool cavity defined by the housing. For example, in one embodiment, the lift station may include a single lift spool disposed within the housing. In another embodiment, the lift station includes a first lift spool and a second lift spool disposed within the housing of the lift station, with the first lift spool being rotatable within the housing for winding and unwinding a front lift cord of the covering, and the second lift spool being rotatable within the housing for winding and unwinding a rear lift cord of the covering. Additionally, the lift station also includes first and second outriggers extending outwardly from opposed sides of the housing. The first outrigger is configured to define a first cord guide surface for guiding the front lift cord between a front side of the covering and the first lift spool. Similarly, the second outrigger is configured to define a second cord guide surface for guiding the rear lift cord between a rear side of the covering and the second lift spool.

In one embodiment, the housing of the lift station includes opposed first and second sides, with the outriggers extending outwardly from an outer surface of the housing along the opposed sides of the housing. For example, in one embodiment, the first outrigger includes a first proximal end positioned adjacent to the outer housing surface and a first distal end spaced apart from the outer housing surface and extends outwardly from the outer surface of the housing along the first side of the housing between the first proximal end and the first distal end. In such an embodiment, the first cord guide surface of the first outrigger may be defined between the proximal and distal ends of the first outrigger for guiding the front lift cord between the first lift spool of the lift station and the distal end of the first outrigger. Additionally, in one embodiment, the second outrigger includes a second proximal end positioned adjacent to the outer housing surface and a second distal end spaced apart from the outer housing surface and extends outwardly from the outer surface of the housing along the second side of the housing between the second proximal end and the second distal end. In such an embodiment, the second cord guide surface of the second outrigger may be defined between the proximal and distal ends of the second outrigger for guiding the rear lift cord between the second lift spool of the lift station and the distal end of the second outrigger.

It should be appreciated that, by configuring the disclosed lift station to include the outriggers described herein, the front and rear lift cords may be efficiently and effectively conveyed between the front and rear sides of the covering, respectively, and the associated lift spools of the lift station. Specifically, the first outrigger may be designed such that the front lift cord is properly positioned relative to the front side of the covering as it exits the lift station (e.g., at the distal end of the first outrigger) and subsequently extends vertically between the top and bottom rails of the associated covering. Similarly, the second outrigger may be designed such that the rear lift cord is properly positioned relative to the rear side of the covering as it exits the lift station (e.g., at the distal end of the second outrigger) and subsequently extends vertically between the top and bottom rails of the covering. As a result of the cord-positioning function of the outriggers, the remainder of the lift station can be configured, as necessary or desired, to meet the size constraints of the rail within which it is installed (e.g., the bottom rail) and/or any other design considerations for the lift station. For example, as will be described below, the cord-positioning function of the outriggers may allow for the lift spools of the lift station to be coaxially aligned along a common rotational axis, thereby eliminating the need for separate lift rods to drive separate lift spools located side-by-side within the rail. In other words, in one embodiment, a common lift cord may be used to rotate both lift spools in the same rotational direction about the common rotational axis.

In one embodiment, a first guide channel is formed at least partially by the first cord guide surface of the first outrigger that defines a first cord entry/exit location at the at the proximal end of the first outrigger and a second guide channel is formed at least partially by the second cord guide surface of the second outrigger that defines a second cord entry/exit location at the at the proximal end of the second outrigger. In one embodiment, the first cord entry/exit location is axially offset from the second cord entry/exit location in the axial direction of the lift station. Additionally, in one embodiment, the first cord entry/exit location is aligned with a first plane extending perpendicular to a central axis of the housing of the lift station and passing through a location at which the first lift cord contacts the first lift spool when the first lift cord is being wrapped around the first lift spool. Similarly, in one embodiment, the second cord entry/exit location is aligned with a second plane extending perpendicular to the central axis of the housing of the lift station and passing through a location at which the second lift cord contacts the second lift spool when the second lift cord is being wrapped around the second lift spool.

In one embodiment, the distal ends of both outriggers are configured to be aligned along a common plane about which the front and rear lift cords enter and exit the lift station. In such an embodiment, the orientation of each outrigger as it extends outwardly from the housing may vary depending on the axial location of such common cord entry/exit plane. For example, in one embodiment, the cord entry/exit plane may be aligned with the axial location at which the rear lift cord winds around and unwinds from the second lift spool and/or axially aligned with the proximal end of the second outrigger. In such an embodiment, the second outrigger may generally extend from the housing substantially parallel to the cord entry/exit plane so that its cord guide surface is substantially aligned with the cord entry/exit plane between the proximal and distal ends of the second outrigger. As a result, the rear lift cord may traverse the cord guide surface defined by the second outrigger along the cord entry/exit plane as the rear lift cord is wound around and unwound from the second lift spool. Additionally, in such an embodiment, given that the axial location at which the front lift cord winds around and unwinds from the first lift spool is axially offset from such corresponding axial location on the second lift spool, the first outrigger may extend from the housing at an angle relative to the cord entry/exit plane to allow the distal end of the first outrigger to be substantially aligned with the cord entry/exit plane (and, thus, the distal end of the second outrigger). In such an embodiment, the proximal end of the first outrigger is offset from the cord entry/exit plane in the axial direction of the housing of the lift station. Similarly, in such an embodiment, the cord guide surface defined between the proximal and distal ends of the first outrigger is also axially offset from the cord entry/exit plane. As such, the front lift cord may traverse the cord guide surface defined by the first outrigger between its proximal and distal ends at an angle relative to the cord entry/exit plane as the front lift cord is wound around and unwound from the first lift spool, thereby allowing the front cord guide to be guided between the cord entry/exit plane and the axially offset location at which the front lift cord winds around and unwinds from the first lift spool.

In other embodiments, the above-described configurations of the outriggers may differ. For example, in an alternative embodiment, the first outrigger may be aligned with the cord entry/exit plane while the second outrigger may extend from the housing at an angle relative to the cord entry/exit plane to allow the distal end of the second outrigger to be substantially aligned with the cord entry/exit plane. In another embodiment, the cord entry/exit plane may be aligned with a central plane of the housing of the lift station that is axially offset from both axial locations at which the lift cords wind around and unwind from the lift spools. In such an embodiment, both outriggers may define angled orientations between their proximal and distal ends to allow the lift cords to be delivered from each respective lift spool to the distal ends of the outriggers aligned with the cord entry/exit plane. However, as indicated above, in other embodiments, the central plane of the housing of the lift station may be axially offset from the cord entry/exit plane.

In one embodiment, the lift station may be configured to be offset from the center of the rail within which it is being installed. In such an embodiment, the length to which each outrigger extends outwardly from the housing may vary. For instance, in an embodiment in which the lift station is configured to be positioned within its corresponding rail at a location closer to the rear side of the covering, the first outrigger may be longer than the second outrigger to allow the front lift cord to be properly guided between the first lift spool of the lift station and the front side of the covering.

Additionally, in one embodiment, each of the guide surfaces defined by the outriggers may be configured to define a curved cord path for its corresponding lift cord. For instance, each cord guide surface may have an arcuate or curved profile as it extends between the proximal and distal ends of its associated outrigger, such as by configuring the first cord guide surface to define a curved cord path between the proximal and distal ends of the first outrigger and by configuring the second cord guide surface to define a curved cord path between the proximal and distal ends of the second outrigger. In such an embodiment, the radius of curvature of each guide surface may be selected, for example, so as to reduce loading on the lift cords (e.g., friction loads) as the cords are wound around and unwound from the lift spools when raising and lowering the covering.

Moreover, in one embodiment, the outriggers may be configured to be formed integrally with the housing of the lift station. For instance, as will be described below, the first and second outriggers may be formed integrally with a given portion of the housing (e.g., as a single, integral molded component).

As indicated above, in several embodiments, the disclosed lift station may be incorporated into a covering for an architectural structure. For example, in one embodiment, the covering includes a headrail, a bottom rail, and at least one covering element supported between the headrail and bottom rail. Additionally, the covering includes a front lift cord extending along a front side of the covering between the headrail and the bottom rail, and a rear lift cord extending along a rear side of the covering between the headrail and the bottom rail. In such an embodiment, each of the lift cords may be provided in operative association with the disclosed lift station for winding and unwinding the cords as the bottom rail is raised and lowered, respectively, relative to the bottom rail. For example, the lift station may be positioned within the bottom rail of the covering and may be configured to wind/unwind the lift cords around/from its respective lift spools as the bottom rail is raised and lowered relative to the headrail.

In one embodiment, the covering may correspond to a "privacy" Venetian-type blind including a plurality of slats supported between the headrail and bottom rail. In such an embodiment, the front and rear lift cords may be provided as opposed to the central lift cords utilized with conventional Venetian blinds that extend through corresponding, centralized route slots defined through the slats. Specifically, the front and rear lift cords may extend vertically along the front and rear edges of the slats without passing through such conventional route slots. As a result, the disclosed covering may provide increased light blocking functionality and improved privacy as compared to conventional Venetian blinds.

In one embodiment, the bottom rail includes a front wall positioned along the front side of the covering and an opposed rear wall positioned along the rear side of the covering. In such an embodiment, the first outrigger may be configured to extend outwardly from the housing of the lift station towards the front wall of the bottom rail, such as by extending outwardly from an outer surface of the housing so that the distal end of the first outrigger is located adjacent to the front wall of the bottom rail. Similarly, the second outrigger may be configured to extend outwardly from the housing of the lift station towards the rear wall of the bottom rail, such as by extending outwardly from an outer surface of the housing so that the distal end of the second outrigger is located adjacent to the rear wall of the bottom rail.

Additionally, in one embodiment, the covering may include a cover strip extending between the front and rear walls of the bottom rail along a top side of the rail. In one embodiment, the cover strip may define front and rear route slots for allowing passage of the front and rear lift cords and/or distal portions of the outriggers therethrough. For instance, in a particular embodiment, the front and rear route slots of the cover strip may be configured to allow portions of the first and second outriggers, respectively, to pass therethrough such that the distal end of each outrigger is positioned between the cover strip and its respective lift cord, thereby allowing the distal ends of the outriggers to shield the lift cords from any sharp edge(s) of the cover strip and, thus, to prevent damage to the lift cords. Additionally, in one embodiment, the first lift cord may be configured to extend from the distal end of the first outrigger between the cover strip and the front wall of the bottom rail along the front side of the covering while the second lift cord may be configured to extend from the distal end of the second outrigger between the cover strip and the rear wall of the bottom rail along the rear side of the covering.

Moreover, in one embodiment, the bottom rail may define front and rear route slots along its top side for receiving the front and rear lift cords and/or distal portions of the outriggers. For instance, in one embodiment, the front lift cord may be configured to extend vertically from the distal end of the first outrigger through the front route slot defined in the bottom rail while the rear lift cord may be configured to extend vertically from the distal end of the second outrigger through the rear route slot defined in the bottom rail.

It should be appreciated that, although the present subject matter will generally be described herein with reference to the disclosed lift station including first and second lift spools around which front and rear lift cords, respectively, of the covering are received, the lift station may, instead, only include a single lift spool around which a single lift cord (e.g., a front lift cord or a rear lift cord of the covering) is wound. For instance, it may be desirable to alternate between front and rear lift cords across two or more of the lift stations of a covering. In such an embodiment, for example, a first lift station of the covering may include a single lift spool around which the front lift cord is configured to be wound while a second lift station of the covering may include a single lift spool around which the rear lift cord is configured to be wound. By alternating between front and rear lift cords for the lift stations of a given covering, there may be an overall reduction in parts and labor for the covering (e.g., by eliminating a lift spool and associated lift cord at each lift station). In addition, such an alternating cord arrangement may allow for narrower coverings to be manufactured and/or may provide a different visual look to the front and/or rear of the covering. Alternatively, the lift station may include a single, common lift spool around which both the front and rear lift cords are wound.

Figure 2:
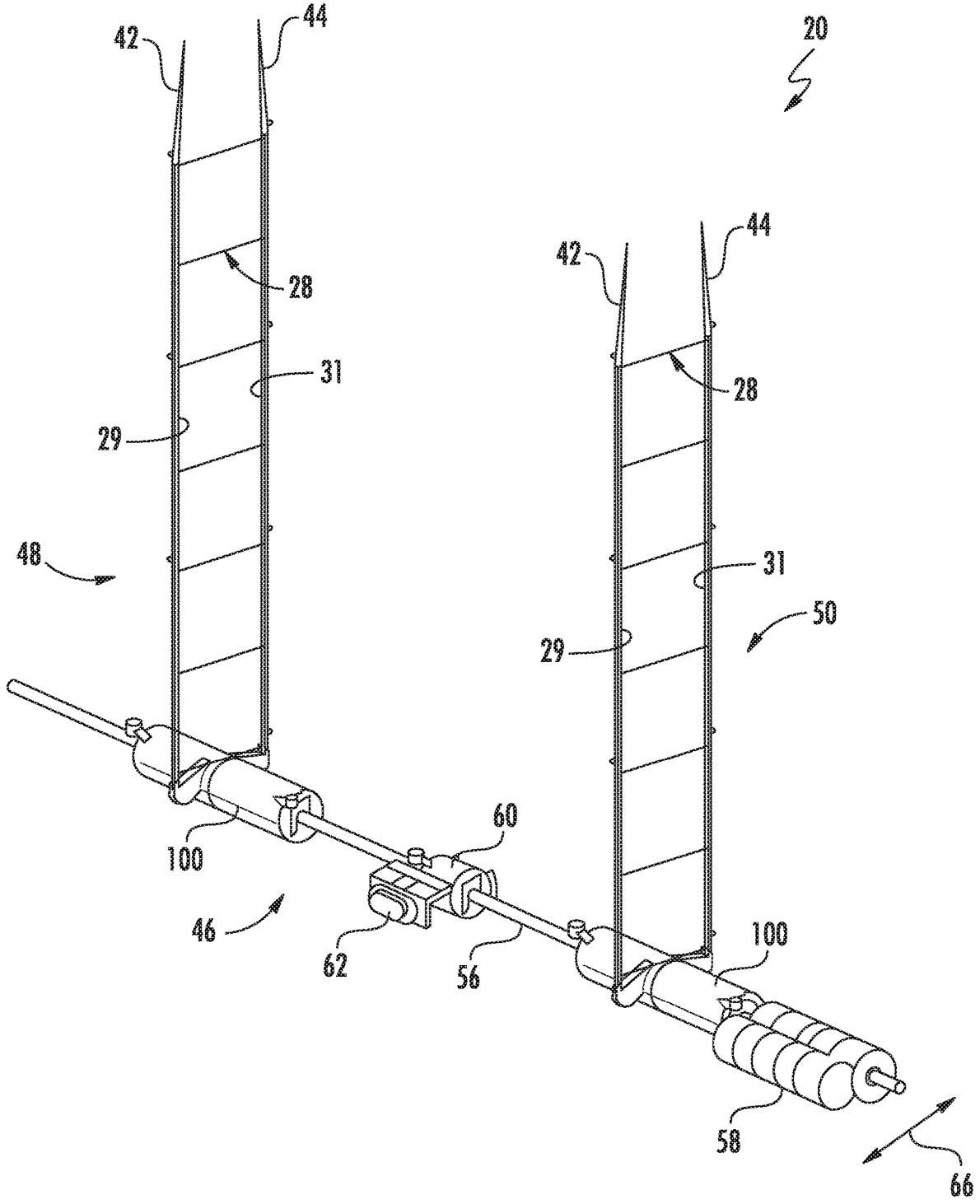
FIG. 2 illustrates another perspective view of the covering shown in FIG. 1, particularly illustrating the headrail (as well its internal components), the slats, and the bottom rail of the covering removed for purposes of illustration.

Referring now to FIGS. 1 and 2, differing views of one embodiment of a covering 20 for an architectural structure (not shown) are illustrated in accordance with aspects of the present subject matter. Specifically, FIG. 1 illustrates a perspective view of the covering 20. Additionally, FIG. 2 illustrates another perspective view of the covering 20 shown in FIG. 1, with the bottom rail removed to illustrate various internal operating components of the covering 20. The head rail and its associated internal components, as well as the slats, have also been removed from the covering 20 shown in FIG. 2 for purposes of illustration.

In general, the covering 20 is configured to be installed relative to a window, door, or any other suitable architectural structure as may be desired. In one embodiment, the covering 20 may be configured to be mounted relative to an architectural structure to allow the covering 20 to be suspended or supported relative to the architectural structure. It should be understood that the covering 20 is not limited in its particular use as a window or door shade, and may be used in any application as a covering, partition, shade, and/or the like, relative to and/or within any type of architectural structure.

In several embodiments, the covering 20 may be configured as a "privacy" Venetian-blind-type extendable/retractable covering. For example, in the embodiment shown in FIGS. 1 and 2, the covering 20 includes a headrail 22, a bottom rail 24, and one or more covering elements extending between the headrail 22 and the bottom rail 24, such as a plurality of horizontally disposed parallel slats 26 configured to be supported between the headrail 22 and the bottom rail 24 via one or more cord ladders 28. As is generally understood, the slats 26 are rotatable or tiltable about their longitudinal axes by manipulating the cord ladders 28 to allow the slats 26 to be tilted between a horizontal or open position (e.g., as shown in FIG. 1) for permitting light to pass between the slats 26 and a closed position (not shown), wherein the slats 26 are substantially vertically oriented in an overlapping manner to occlude or block the passage of light through the covering 20. It should be appreciated that the cord ladders 28 may be manipulated to allow for the slats 26 to be tilted between their open and closed positions using, for example, a suitable tilt wand 30 or any other suitable control device forming part of a tilt system 32 provided in operative association with the covering 20. For example, as shown in FIG. 1, the covering 20 includes one or more components of the tilt system 32 within the head rail 22, such as a tilt station 34 provided in operative association with each cord ladder 28 and a tilt rod 36 coupled between the tilt wand 30 and the tilt stations 34. In such an embodiment, as the tilt wand 30 is manipulated by the user (e.g., by rotating the tilt wand 30 relative to the headrail 22), the tilt rod 36 may be rotated to rotationally drive the tilt stations 34, thereby allowing a front ladder run 29 (FIG. 2) or a rear ladder run 31 (FIG. 2) of each cord ladder 28 to be raised or lowered relative to each other to adjust the tilt angle of the slats 26. It should be appreciated that each tilt station 34 may generally have any suitable configuration, including any conventional tilt station configuration and/or any other suitable configuration that allows the tilt stations 34 to function as described herein.

It should be appreciated that, although the covering 20 is shown in the illustrated embodiment as including slats 26, the covering 20 may instead including any other suitable covering element(s) configured to extend between the headrail 22 and the bottom rail 24. For instance, in another embodiment, the covering element(s) may correspond to one or more sheet-like covering materials, a cellular panel or blanket, and/or the like.

Moreover, as shown FIGS. 1 and 2, the covering 20 also includes one or more pairs of lift cords 42, 44 (separate from the cord ladders 28) forming part of a lift system 46 for moving the covering 20 between a lowered or extended position (e.g., as shown in FIGS. 1 and 2) and a raised or retracted position (not shown). For instance, as shown in FIGS. 1 and 2, the covering 20 includes two pairs of lift cords 42, 44 extending between the headrail 22 and the bottom rail 24. Each lift cord pair in FIGS. 1 and 2 includes a front lift cord 42 extending along a front side 48 of the covering 20, and a rear lift cord 44 extending along a rear side 50 of the covering 20. Specifically, each front lift cord 42 is configured to extend between the headrail 22 and the bottom rail 24 along a front edge 52 (FIG. 10) of each slat 26, while each rear lift cord 44 is configured to extend between the headrail 22 and the bottom rail 24 along an opposed rear edge 54 (FIG. 10) of each slat 26. In one embodiment, the front side 48 of the covering 20 may generally be defined by a vertical plane in which the front edges 52 of the slats 26 lie and which extends between the headrail 22 and the bottom rail 24. Similarly, in one embodiment, the rear side 50 of the covering 20 may generally be defined by a vertical plane in which the rear edges 54 of the slats 26 lie and which extends between the headrail 22 and the bottom rail 24.

It should be appreciated that, in other embodiments, the covering 20 may only include a front lift cord 42 or a rear lift cord 44 at the locations of the lift cord pairs shown in FIGS. 1 and 2. For example, in one embodiment, the covering 20 may include a front lift cord 42 extending between the headrail 22 and the bottom rail 24 along the front edge 52 (FIG. 10) of each slat 26 at the location of one of the cord ladders 28 and a rear lift cord 44 extending between the headrail 22 and the bottom rail 24 along the rear edge 54 of each slat 26 at the location of the other cord ladder 28.

In accordance with aspects of the present subject matter, each pair of lift cords 42, 44 is configured to extend to a corresponding lift station 100 to control the vertical positioning of the bottom rail 24 relative to the headrail 22. For instance, as shown in FIG. 2, each pair of lift cords 42, 44 is operatively coupled to a lift station 100 housed within the bottom rail 24 (FIG. 1). In such an embodiment, a bottom end (not shown) of each lift cord 42, 44 is configured to be coupled to its associated lift station 100 while an opposed end (not shown) of each lift cord 42, 44 is configured to be coupled to the headrail 22. As will be described below, each lift station 100 includes one or more lift spools (e.g., a pair of lift spools) for winding and unwinding the respective lift cords 42, 44 of each pair of lift cords. Thus, as the bottom rail 24 is raised relative to the headrail 22, each lift cord 42, 44 is wound around its respective lift spool. Similarly, as the bottom rail 24 is lowered relative to the headrail 22, each lift cord 42, 44 is unwound from its respective lift spool. It should be appreciated that, although the disclosed lift station 100 will generally be described herein with reference to being positioned within the bottom rail 24, those of ordinary skill in the art will appreciated that, in other embodiments, the lift station 100 may be housed within the headrail 22.

As shown in FIG. 2, the lift system 46 of the covering 20 also includes a lift rod 56 operatively coupled to the lift stations 100 and a spring motor 58 operatively coupled to the lift rod 56. As is generally understood, the spring motor 58 may be configured to store energy as the bottom rail 24 is lowered relative to the headrail 22 and release such energy when the bottom rail 24 is being raised relative to the headrail 22 to assist in moving the covering 20 to its retracted position. For instance, as the bottom rail 24 is being raised relative to the headrail 22, the spring motor 58 may transfer a driving torque to the lift rod 56 for rotationally driving the lift stations 100 in a manner that causes each lift cord 42, 44 to be wound around its respective lift spool of the associated lift station 100. Specifically, as the lift rod 56 rotates in one direction about its axis of rotation, each lift cord 42, 44 may wind around its respective lift spool to retract the covering 20. Similarly, as the lift rod 56 rotates in the opposite direction, each lift cord 42, 44 may unwind from its respective lift spool to extend the covering 20.

In one embodiment, the spring motor 58 may be underpowered such that motor 58 is unable to raise the bottom rail 24 alone and needs additional input from the user to accomplish that task. Additionally, such an underpowered spring motor 58 may also be unable to hold the bottom rail 24 in place once it is released by the user. In such an embodiment, to prevent unintended motion of the bottom rail 24 relative to the headrail 22, a brake 60 may be provided within the bottom rail 22 and may be operatively coupled to the lift rod 56 to stop rotation of the lift rod 56. As shown in FIGS. 1 and 2, to actuate the brake 60, an actuator button 62 is coupled to the bottom rail 24. In such an embodiment, when the actuator button 62 is depressed by the user, the brake 60 is released or disengaged from the lift rod 56, thereby allowing the lift rod 56 to be rotated in a manner that permits the lift cords 42, 44 to be wound around or unwound from their respective lift spools as the bottom rail 24 is lowered or raised, respectively, relative to the headrail 22. Similarly, when the actuator button 62 is released by the user, the brake 60 engages with the lift rod 56, thereby preventing rotation of the lift rod 56 and, thus, maintaining the position of the bottom rail 24 relative to the headrail 22. Suitable embodiments of the brake 60 and actuator button 62 are described, for example, in U.S. Pat. No. 9,422,766 (Anderson et al.) and U.S. Pat. No. 9,708,850 (Anderson et al.), both of which are hereby incorporated by reference herein in their entirety for all purposes.

In other embodiments, the spring motor 58 may not be underpowered, thereby eliminating the need for the brake 60 and associated actuator button 62. In such an embodiment, the spring motor 58 may be sufficiently powered such that it can hold the bottom rail 24 in place once it is released by the user and/or such that it can raise the bottom rail 24 without additional input from the user. For example, in one embodiment, the spring motor 58 may be overpowered.

Referring now to FIGS. 3-9, several views of one embodiment of a lift station 100 suitable for use with a covering for an architectural structure are illustrated in accordance with aspects of the present subject matter. For purposes of discussion, the lift station 100 shown in FIGS. 3-9 will generally be described herein with reference to the embodiment of the covering 20 shown in FIGS. 1 and 2. However, it should be appreciated that, in general, the disclosed lift station 100 may be utilized within any suitable covering having any suitable covering configuration.

In general, the lift station may be configured to facilitate raising and lowering of a bottom rail relative to a headrail by winding and unwinding, respectively, front and rear lift cords of the associated covering about its lift spools. As indicated above with reference to FIG. 2, in one embodiment, the lift station is configured to be positioned within the interior of the bottom rail 24 of the covering 20. In such an embodiment, the lift station may include suitable structure for guiding the front and rear lift cords 42, 44 between the lift spools of the lift station and the front and rear sides 48 50, respectively, of the bottom rail 24 to allow each lift cord 42, 44 to extend vertically from such structure towards the headrail 22 along its respective side 48, 50 of the covering 20. For instance, as will be described below, in several embodiments, the lift station includes first and second outriggers extending outwardly from opposed sides of the lift station's housing towards the front and rear sides 48, 50 of the covering 20. In such an embodiment, each outrigger may define a cord guide surface for guiding each respective lift cord 42, 44 between its associated lift spool and either the front side 48 or the rear side 50 of the covering 20. As a result, the outriggers may be configured to properly position the lift cords 42, 44 relative to the front and rear sides 48, 50 of the covering 20 as the bottom rail 24 is being raised and lowered relative to the headrail 22.

Figure 3:
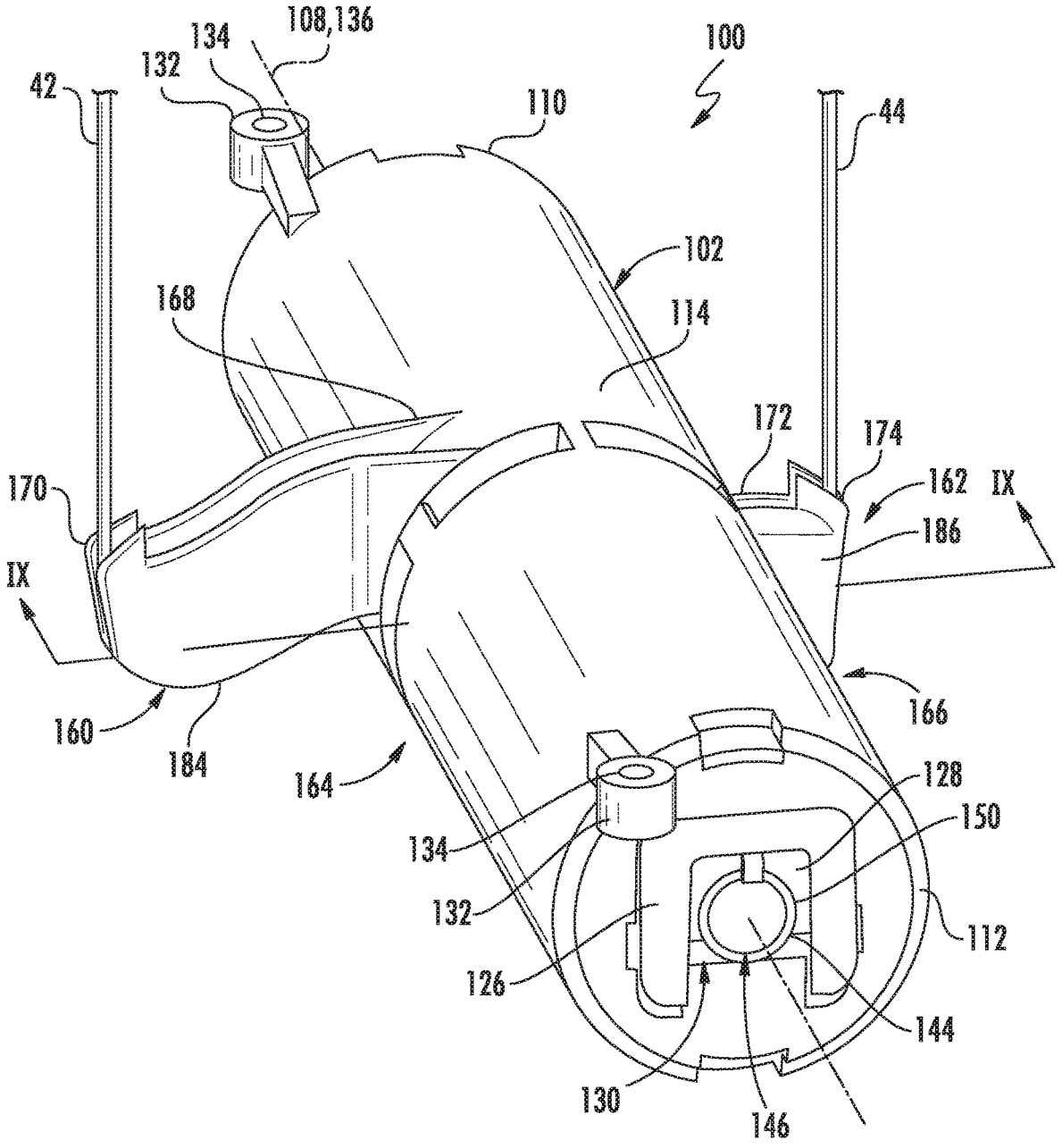
FIG. 3 illustrates a perspective view of one embodiment of a lift station suitable for use with a covering for an architectural structure in accordance with aspects of the present subject matter.
Figure 4:
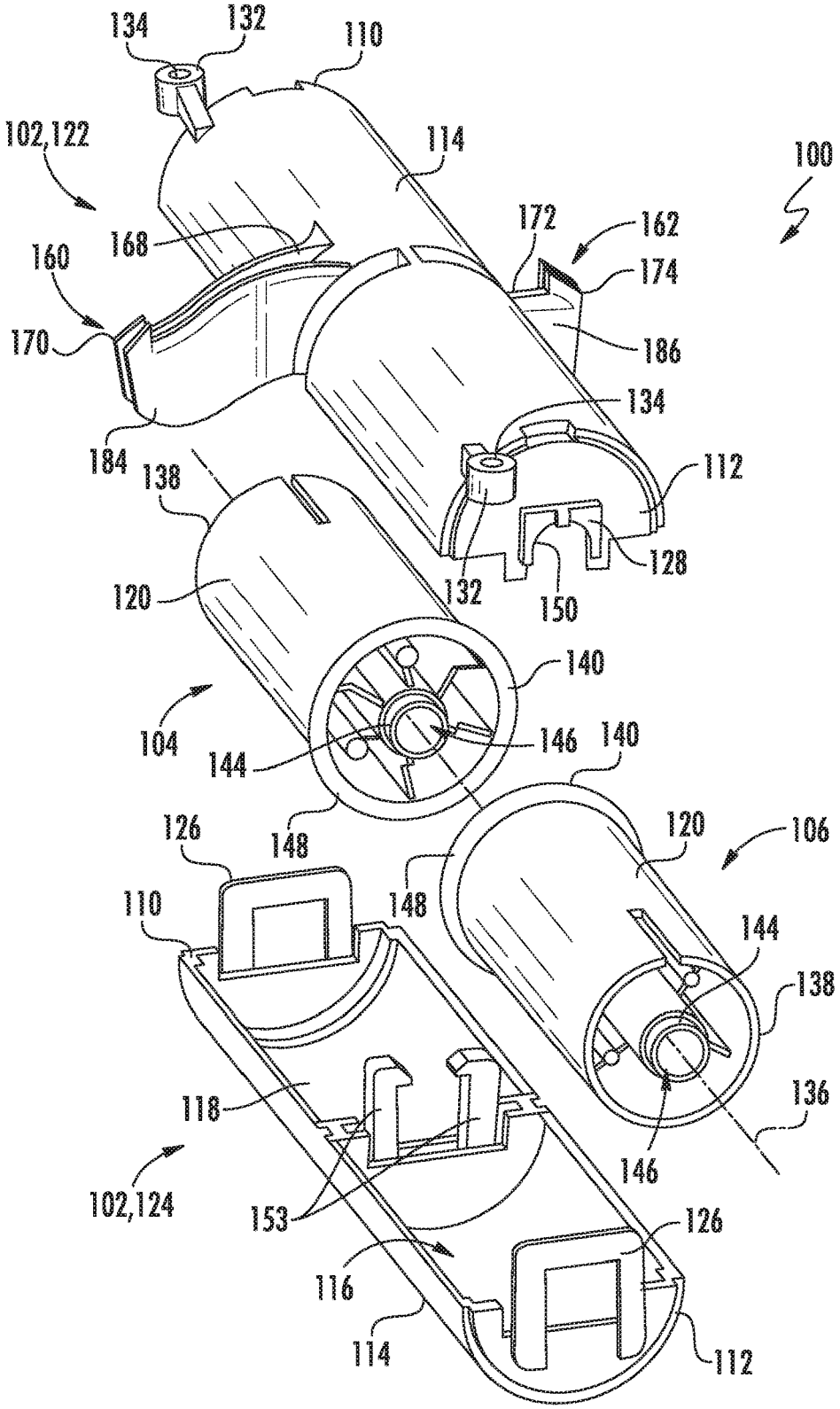
FIG. 4 illustrates an exploded view of the lift station shown in FIG. 3.

As particularly shown in FIGS. 3 and 4, the lift station 100 generally includes a housing 102 configured to encase a pair of lift spools (e.g., a first lift spool 104 and a second lift spool 106). In one embodiment, the housing 102 may correspond to a substantially cylindrically shaped body extending lengthwise along a central axis 108 (FIGS. 3 and 5) between a first end 110 of the housing 102 and an opposed, second end 112 of the housing 102. However, in other embodiments, the housing 102 need not be cylindrically shaped and may define any other suitable shape between its first and second ends 110, 112. As will be described below, the central axis 108 of the housing 102 may be coaxially aligned, for example, with the axis of rotation of the lift rod 56 of the covering 20 (and the corresponding rotational axes of the lift spools 104, 106) when the lift station 100 is installed within the bottom rail 24. As shown in FIG. 3, the housing 102 defines an outer surface 114 (e.g., a cylindrically-shaped outer surface) around its outer perimeter or exterior. Additionally, as shown in FIG. 4, the housing 102 is hollow so as to define a spool cavity 116 for accommodating the lift spools 104, 106. For example, in the illustrated embodiment, the spool cavity 116 is defined by an inner surface 118 (FIGS. 4 and 6) of the housing 102 extending around its inner perimeter. In one embodiment, the dimensions of the housing 102 may be selected based on the outer diameter of the lift spools 104, 106 such that a radial gap (not shown) of a given size is defined between the inner surface 118 of the housing 102 and an outer surface 120 (FIG. 4) of each spool 104, 106 that assists in spooling and/or indexing of the lift cords 42, 44 as each lift cord 42, 44 is wrapped around its respective lift spool 104, 106.

In several embodiments, the housing 102 may be configured as a multi-piece construction, such as a two-part assembly. For instance, as shown in FIG. 4, the lift station 100 includes an upper or first housing component 122 and a lower or second housing component 124 configured to be coupled to each other to form the complete housing 102. In such an embodiment, when the first and second housing components 122, 124 are coupled together, the housing components 122, 124 collectively define the spool cavity 116 of the housing 102, and, thus, are configured to encase the lift spools 104, 106. In general, the housing components 122, 124 may be configured to be coupled to each other using any suitable attachment structure and/or means. For instance, in the illustrated embodiment, the second housing component 124 includes cantilevered yokes 126 extending from its opposed ends that are configured to engage corresponding bosses 128 (only one of which is shown) defined at the opposed ends of the first housing component 122. In such an embodiment, when the first and second housing components 122, 124 are being assembled together, each yoke 126 may flex outwardly as it is pushed past its respective boss 128 until the yoke 126 clears the boss 128, thereby allowing the yoke 126 to spring back and engage around the boss 128 to couple the ends of the housing components 122, 124 to each other. In other embodiments, the housing components 122, 124 may include any other suitable attachment structure and/or the lift station 100 may be configured to include any other suitable components for coupling the housing components 122, 124 to each other (e.g., by using suitable mechanical fasteners).

As shown in FIG. 3, when the housing components 122, 124 are assembled together, each end 110, 112 of the housing 102 defines an opening 130 (only one of which is shown), such as through the yokes 126, for receiving the lift rod 56 of the associated covering 20. In such an embodiment, the lift rod 56 may be configured to pass through the openings 130 without engaging the housing 102. Additionally, as will be described below, the lift rod 56 may extend through each of the lift spools 104, 106 so as to rotationally couple the spools 104, 106 to the lift rod 56. As such, when the lift rod 56 is installed through the lift station 100, the lift spools 104, 106 may rotate with rotation of the lift rod 56 relative to the housing 102.

Figure 15:
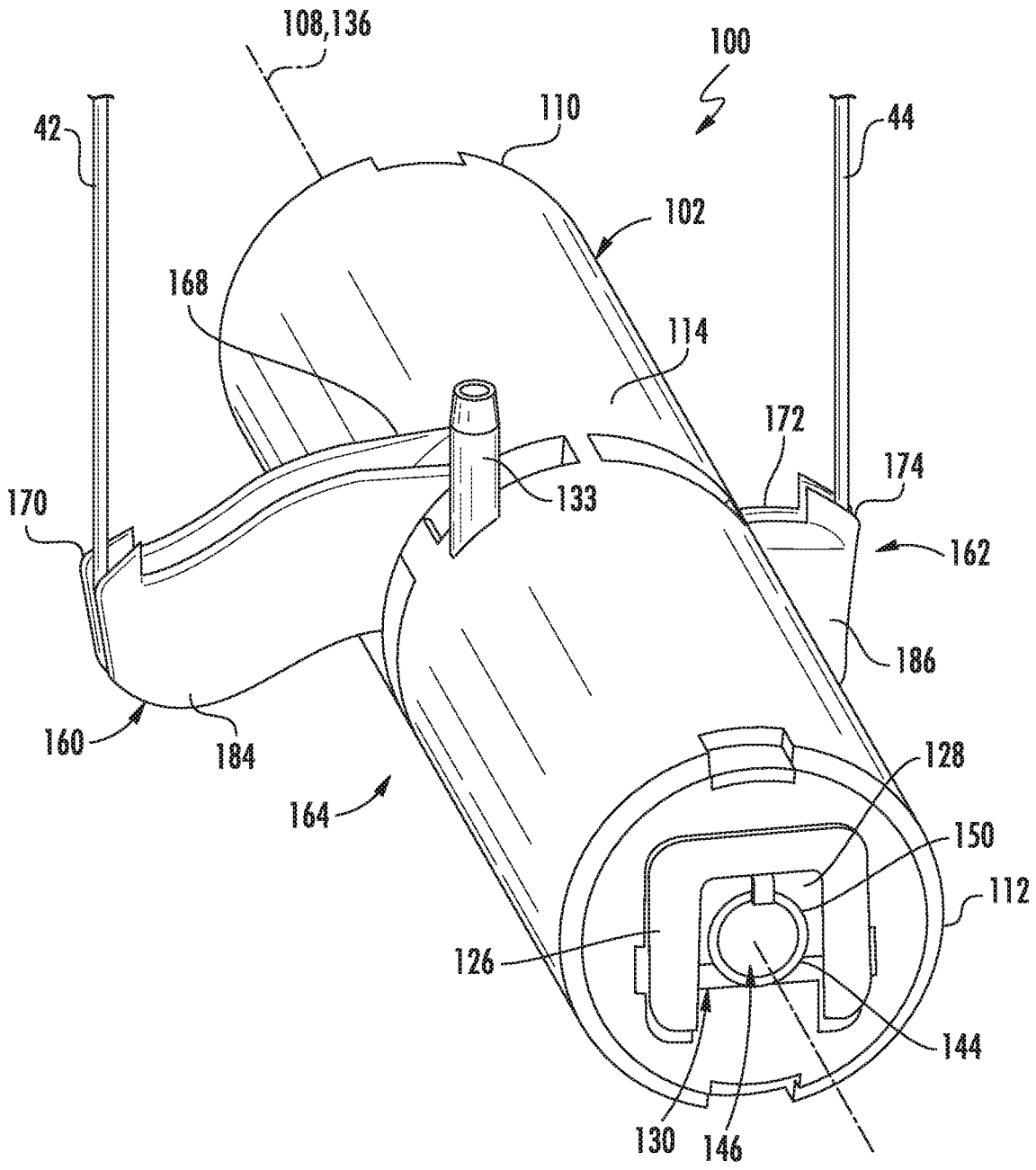
FIG. 15 illustrates a perspective view of an alternative embodiment of a lift station suitable for use with a covering for an architectural structure in accordance with aspects of the present subject matter.

Moreover, it should be appreciated that the housing 102 may also include any other suitable features and/or components for allowing it to function as described herein and/or to allow the housing 102 to be installed relative to the bottom rail 24 of the covering 20. For example, as shown in FIG. 3, the housing 102 includes opposed mounting flanges 132 extending outwardly from the ends 110, 112 of the housing 102 (e.g., the opposed ends of the first housing component 122). In such an embodiment, the mounting flanges 132 may also define fastener openings 134 for receiving fasteners (not shown) configured to couple the lift station 100 to an adjacent component of the covering 20, such as a filler or cover strip 70 (FIG. 10) provided in operative association with the bottom rail 24. For instance, pins may be inserted through both the cover strip 70 and the fastener openings 134 to couple the lift station 100 to the cover strip 70, thereby preventing axial motion of the lift station 100 along the lift rod 56 upon assembly of the covering 20. As an alternative to including mounting flanges 132 extending outwardly from the opposed ends 110, 112 of the housing 102, one or more mounting features may be provided between the ends 110, 112 of the housing 102. For instance, as shown in the alternative embodiment of FIG. 15, a mounting post 133 extends outwardly from the outer surface 114 of the housing 102 at a location between its opposed ends 110, 112 (e.g., at a central location on the housing 102). In such an embodiment, the mounting post 133 is configured to be aligned within an opening (not shown) defined in the cover strip 70 to allow a suitable fastener to be inserted through both the cover strip 70 and a corresponding fastener opening 135 defined in the mounting post 133 to couple the lift station 100 to the cover strip 70. In addition, by requiring the mounting post 133 to be aligned within a corresponding opening defined in the cover strip 70, the mounting post 133 may also serve as an alignment feature between the lift station 100 and the cover strip 70.

As indicated above and as particularly shown in FIG. 4, the lift station 100, in one embodiment, includes first and second lift spools 104, 106 configured to be installed within the housing 102. In general, the first lift spool 104 is configured to be coupled to a bottom end (not shown) of either the front lift cord 42 or the rear lift cord 44 of one of the pairs of lifts cords of the covering 20, while the second lift spool 106 is configured to be coupled to the bottom end (not shown) of the other of the front lift cord 42 or the rear lift cord 44. For purposes of describing the present subject matter and without intent to limit, the first lift spool 104 will be described as being coupled to the front lift cord 42 while the second lift spool 106 will be described as being coupled to the second lift cord 44. As such, with rotation of the lift spools 104, 106, the front lift cord 42 winds around or unwinds from the first lift spool 104 while the rear lift cord 44 winds around or unwinds from the second lift spool 106. However, in other embodiments, the cord configuration may be reversed relative to the first and second lift spools 104, 106.

In several embodiments, the first and second lift spools 104, 106 may be configured the same as or similar to each other. For example, in one embodiment, each lift spool 104, 106 generally extends lengthwise about a rotational axis 136 (FIG. 4) between an outer end 138 of the lift spool 104, 106 (e.g., configured to be positioned adjacent to one of the ends 110, 112 of the housing 102) and an inner end 140 of the lift spool 104, 106 (e.g., configured to be positioned adjacent to the center of the housing 102, such as a central plane 142 (FIG. 5) of the housing 102 defined between its opposed ends 110, 112). In several embodiments, the rotational axes 136 of the first and second lift spools 104, 106 may be coaxially aligned when the lift spools 104, 106 are installed within the housing 102. In addition, the rotational axes 136 of the first and second lift spools 104, 106 may also be coaxially aligned with the central axis 108 of the housing 102 and the axis of rotation of the lift rod 56 of the covering 20. As particularly shown in FIG. 4, in one embodiment, each lift spool 104, 106 also includes an internal, hollow spool shaft 144 extending between its opposed ends 138, 140 that defines a rod opening 146 for receiving the lift rod 56. In such an embodiment, the rod openings 146 may, for example, be keyed to the shape of the lift rod 56 (e.g., by including a v-shaped projection configured to mate with a v-shaped channel defined in the lift rod 56) to allow the lift rod 56 to be rotationally coupled to the lift spools 104, 106 when the rod is inserted through the rod openings 146. As a result, rotation of the lift rod 56 will cause the lift spools 104, 106 to rotate.

Additionally, as shown in FIG. 4, in one embodiment, each lift spool 104, 106 includes a cord flange 148 at its inner end 140 that extends radially outwardly from the outer surface 120 of the spool 104, 106. As will be described below, each lift cord 42, 44 may be configured to be wrapped around its associated lift spool 104, 106 at a spool location disposed generally adjacent to the inner end 140 of the lift spool 104, 106. As such, each cord flange 148 may serve to prevent the lift cord 42, 44 from falling off the inner end 140 of the lift spool 104, 106 as it is being wrapped around the spool 104, 106 at the cord exit/entry location. Additionally, each cord flange 148 may also be configured to index the associated lift cord 42, 44 towards the opposite end 138 of the respective spool 104, 106. For example, each cord flange 148 may define a tapered profile configured to urge the lift cord windings in the direction of the opposite end 138 as each lift cord 42, 44 winds around its respective spool 104, 106, thereby preventing overlapping of the lift cord windings.

It should be appreciated that, in several embodiments, the housing 102 may include suitable features and/or may incorporate one or more components to allow the lift spools 104, 106 to be rotationally supported within the housing 102. For instance, as shown in FIG. 4, the bosses 128 of the first housing component 122 define arcuate-shaped bearing surfaces 150 for rotationally supporting the portions of each spool shaft 144 disposed at the outer end 138 of each lift spool 104, 106. Additionally, a similar bearing surface 150 is defined within a central area of the housing 102 (e.g., by an interior boss 152 (FIG. 9) of the first housing component 122) to rotationally support the portions of each spool shaft 144 disposed at the inner end 140 of each lift spool 104, 106. Alternatively, one or more bushings or other suitable rotational components may be installed within the housing 102 to rotationally support the lift spools 104, 106 relative to the housing 102. Additionally, as shown in FIG. 4, in one embodiment, the second housing component 124 includes retainer arms 153 positioned within a central area of the housing 102 that are configured to engage the interior boss 152 (FIG. 9) of the first housing component 122 when the housing components 122, 124 are installed relative to each other.

As indicated above, it should be appreciated that, in other embodiments, only a single lift spool (e.g., the first lift spool 104 or the second lift spool 106) may be installed within the housing 102. In such embodiments, the lift station 100 may only be configured to accommodate or receive a single lift cord (e.g., the front lift cord 42 or the rear lift cord 44). Alternatively, a single, common lift spool may be installed within the housing 102 around which both of the lift cords 42, 44 are configured to be wound.

Referring still to FIGS. 3-9, as indicated above, the lift station 100 also includes outriggers 160, 162 extending from opposed sides of the housing 102 for guiding the lift cords 142, 144 between the lift spools 104, 106 and the front and rear sides 48, 50 of the covering 20. Specifically, as shown in FIG. 3, the lift station 100 includes a first outrigger 160 extending outward from a first side 164 of the housing 102 between a first proximal end 168 located adjacent to the outer surface 114 of the housing 102 and a first distal end 170 spaced apart from the housing's outer surface 114. Similarly, the lift station 100 includes a second outrigger 162 extending outward from an opposed second side 166 of the housing 102 between a second proximal end 172 located adjacent to the outer surface 114 of the housing 102 and a second distal end 174 spaced apart from the housing's outer surface 114. In the illustrated embodiment, the outriggers 160, 162 are formed integrally with the first housing component 122, such as by forming the outriggers 160, 162 and the housing component 122 as a single molded component. However, depending on the configuration of the housing 102, the outriggers 160, 162 may form part of the second housing component 124, or the first outrigger 160 may be formed integrally with one of the housing components 122, 124 while the second outrigger 162 may be formed integrally with the other housing component 122, 124. Alternatively, the outriggers 162, 164 may correspond to separate components configured to be separately coupled to the housing 102, such as along its opposed sides 164, 166.

Figure 7:
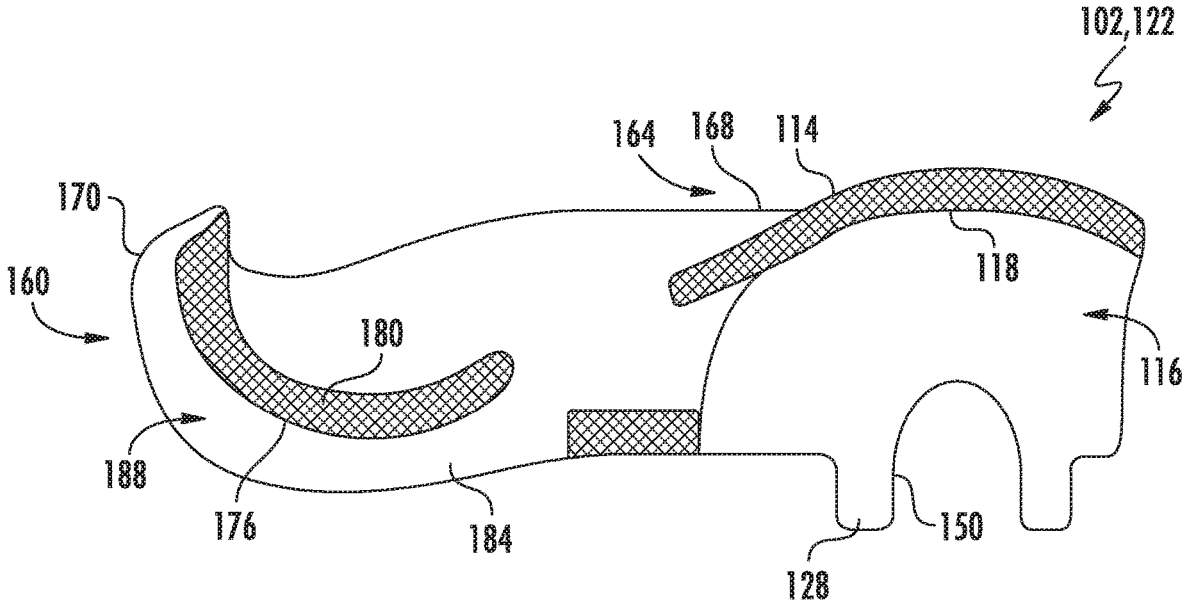
FIG. 7 illustrates a cross-sectional view of the upper or first housing component of the lift station taken about line VII-VII shown in FIG. 5.
Figure 8:
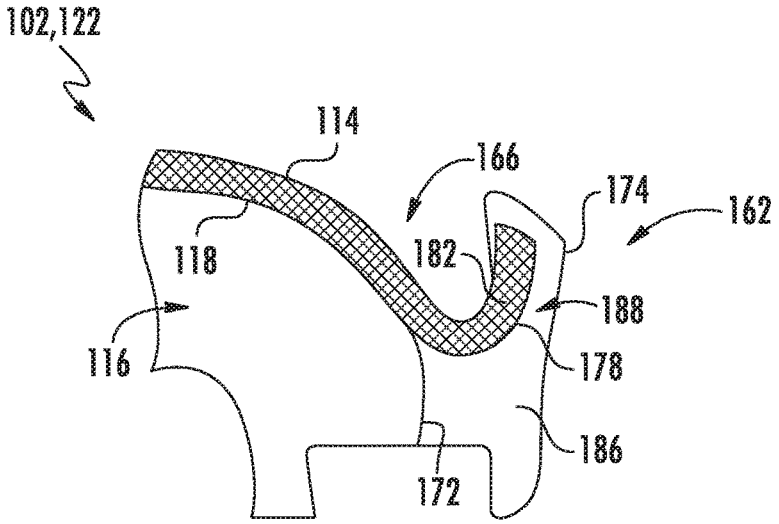
FIG. 8 illustrates a cross-sectional view of the upper or first housing component of the lift station taken about line VIII-VIII shown in FIG. 5.
Figure 9:
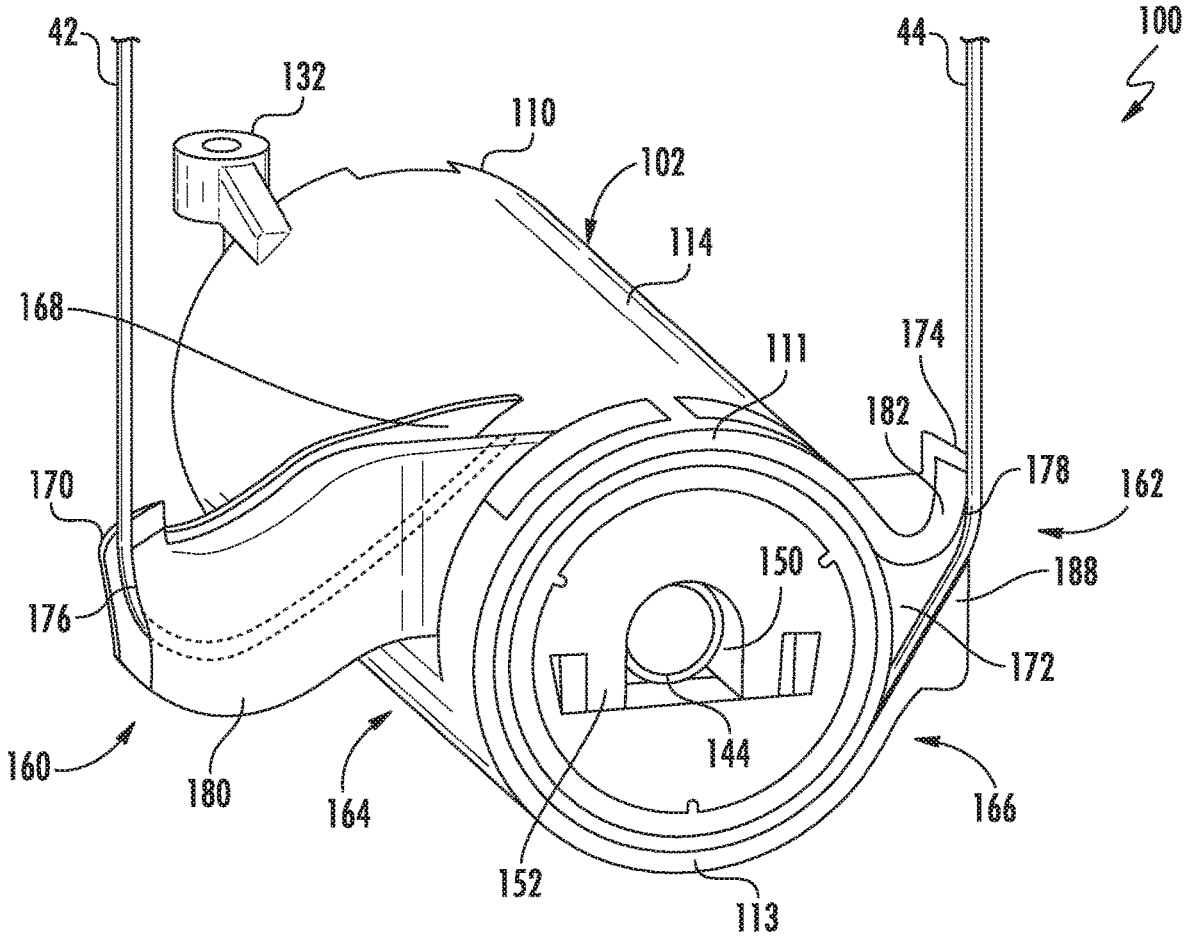
FIG. 9 illustrates another perspective view of the lift station shown in FIG. 3, particularly illustrating a portion of the lift station removed at section line IX-IX shown in FIG. 3.

As indicated above, the outriggers 160, 162 may be configured to define cord guide surfaces for guiding the lift cords 42, 44 between the lift spools 104, 106 and the front and rear sides 48, 50 of the covering 20. For instance, as shown in FIG. 7, the first outrigger 160 defines a first cord guide surface 176 between the proximal and distal ends 168, 170 of the first outrigger 160. As such, when the front lift cord 42 is being wound around and unwound from the first lift spool 104, the lift cord 42 may extend along the first cord guide surface 176 between the opposed ends 168, 170 of the first outrigger 160. Similarly, as shown in FIG. 8, the second outrigger 162 defines a second cord guide surface 178 between the proximal and distal ends 172, 174 of the second outrigger 162. As such, when the rear lift cord 44 is being wound around and unwound from the second lift spool 106, the lift cord 44 may extend along second cord guide surface 178 between the opposed ends 172, 174 of the second outrigger 162.

In several embodiments, each cord guide surface 176, 178 may define a curved or arcuate cord path for its respective lift cord 42, 44. For example, as particularly shown in the cross-sectional view of FIG. 7, the first cord guide surface 176 defines a curved profile between the proximal and distal ends 168, 170 of the first outrigger 160, thereby providing a curved cord path for the front lift cord 42 as it traverses the cord guide surface 176. Similarly, as shown in FIG. 8, the second cord guide surface 178 defines a curved profile between the proximal and distal ends 172, 174 of the second outrigger 162, thereby providing a curved cord path for the rear lift cord 44 as it traverses the cord guide surface 178. Such curved cord guide surfaces 176, 178 may be designed to reduce loads on the cords 42, 44 as they are being wound and unwound from the lift spools 104, 106. For example, it may be desirable to make the radius of curvature of each cord guide surface 176, 178 as large as possible to reduce friction loads on the lift cords 42, 44 across the portions of each guide surface 176, 178 contacted by the lift cords 42, 44.

Figure 6:
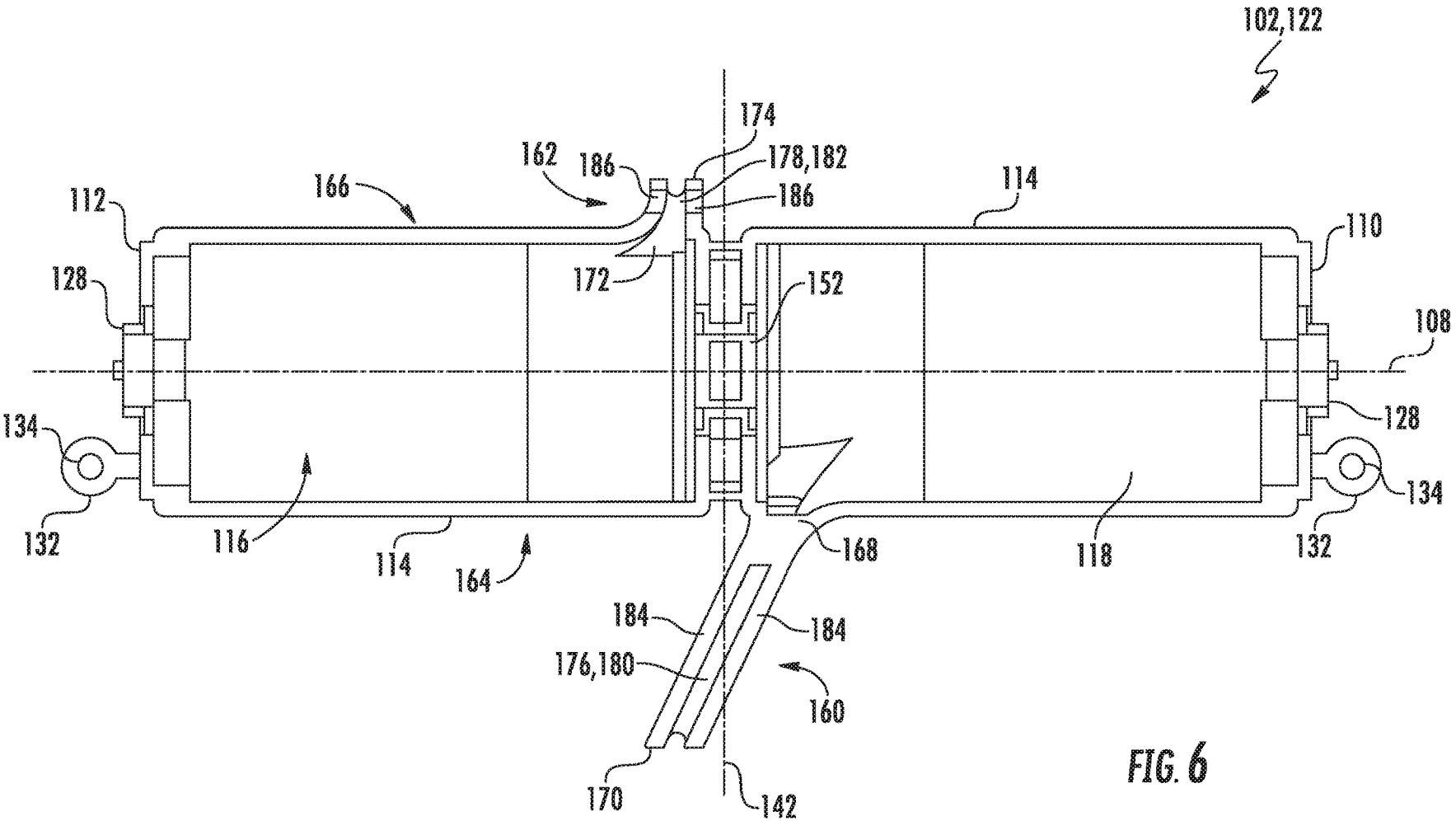
FIG. 6 illustrates a bottom view of an upper or first housing component of the lift station shown in FIG. 5.

As particularly shown in FIGS. 7 and 8, in one embodiment, each cord guide surface 176, 178 is defined by a respective guide wall 180, 182 of each outrigger 160, 162. For example, the first cord guide surface 176 may be defined by a first guide wall 180 of the first outrigger 160 while the second cord guide surface 178 may be defined by a second guide wall 182 of the second outrigger 162. Additionally, in one embodiment, each guide wall 180, 182 may be configured to extend between a corresponding pair of sidewalls 184, 186 of each outrigger 160, 162. For example, as shown in FIG. 6, the first guide wall 180 extends directly between a first pair of sidewalls 184 of the first outrigger 160, while the second guide wall 182 extends directly between a second pair of sidewalls 186 of the second outrigger 162. In such an embodiment, each pair of sidewalls 184, 186 may extend outwardly from their associated guide wall 180, 182 so as to define a guide channel 188 (FIGS. 7 and 8) (e.g., a U-shaped channel) for receiving the associated lift cord 42, 44 as it extends along the adjacent guide surface 176, 178. As such, the sidewalls 184, 186 may serve to trap each lift cord 42, 44 within the guide channel 188 and ensure that the lift cords 42, 44 are maintained in contact with their associated guide surfaces 176, 178.

Figure 5:
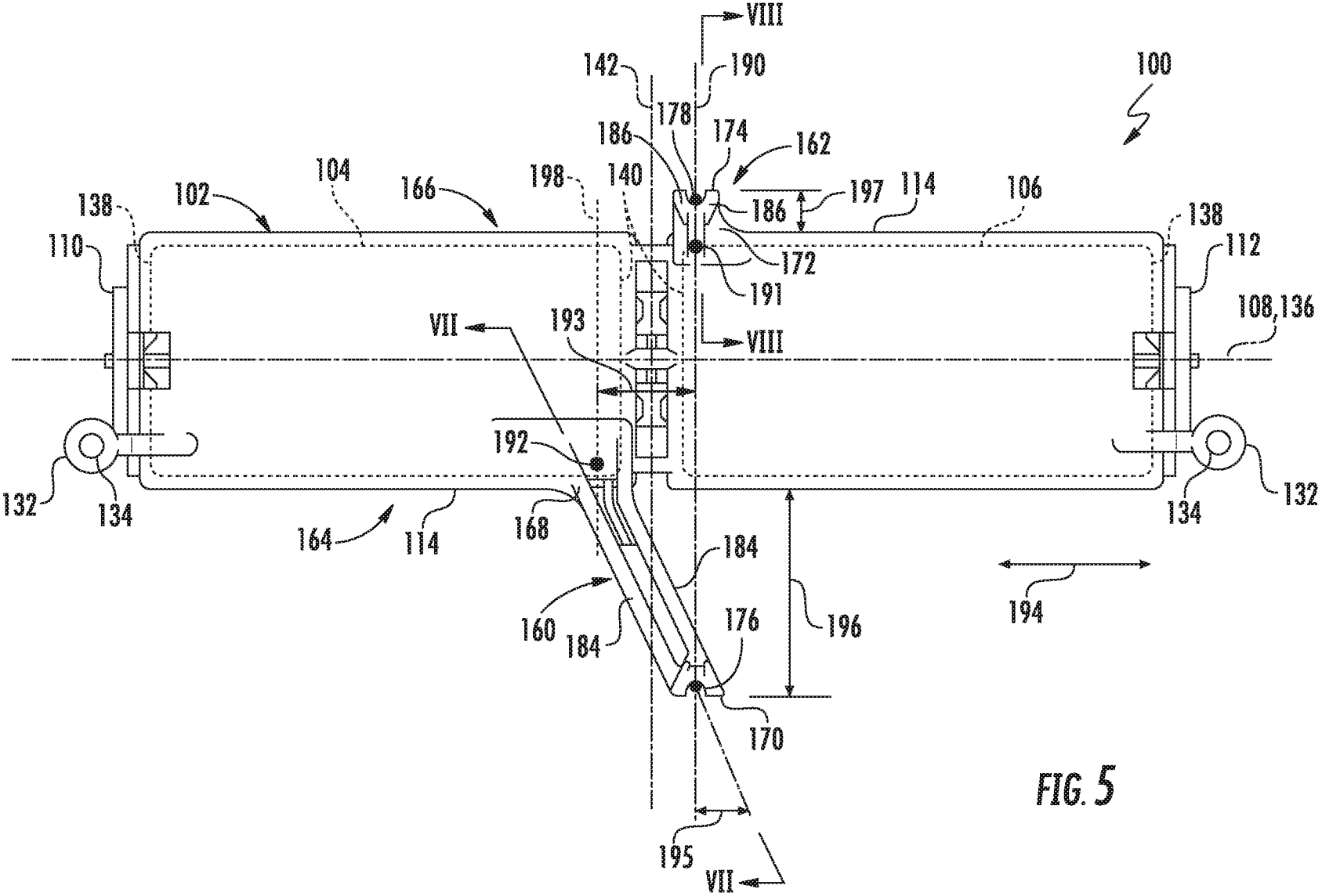
FIG. 5 illustrates a top view of the lift station shown in FIG. 3.

In several embodiments, the outriggers 160, 162 may be configured to be positioned relative to the housing 102 such that the center of each guide channel 188 at the proximal end 168, 172 of each outrigger 160, 162 is aligned with a plane extending perpendicular to the axes 108, 136 of the housing/spools 102, 104, 106 and passing through the location on each respective spool 104, 106 at which the associated lift cord 42, 44 is configured to initially contact the outer surface of its respective spool 104, 106 when wrapping around such spool 104, 106. For example, as shown in FIG. 5, the first outrigger 160 is positioned relative to the housing 102 such that the center of its guide channel 188 (FIG. 7) is defined at a cord entry/exit location 192 at the proximal end 168 of the first outrigger 160 that is aligned with a plane 198 extending perpendicular to the axes 108, 136 of the housing/spools 102, 104, 106 and passing through the location on the first spool 104 at which the first lift cord 42 is configured to initially contact the outer surface of the first spool 104 when wrapping around the spool 104 (e.g., at the base of the sloped or tapered profile of the cord flange 148 of the first spool 104). Similarly, as shown in FIG. 5, the second outrigger 162 is positioned relative to the housing 102 such that the center of its guide channel 188 (FIG. 8) is defined at a cord entry/exit location 191 at the proximal end 172 of the second outrigger 162 that is aligned with a plane 190 extending perpendicular to the axes 108, 136 of the housing/spools 102, 104, 106 and passing through the location on the second spool 106 at which the second lift cord 44 is configured to initially contact the outer surface of the second spool 106 when wrapping around the spool 106 (e.g., at the base of the sloped or tapered profile of the cord flange 148 of the second spool 106).

Additionally, in several embodiments, the front and rear lift cords 42, 44 of the covering 20 may be configured to be axially aligned with each other (e.g., along an axial direction of the housing 102 as indicated by arrow 194 in FIG. 5) as the cords 42, 44 extend from the lift station 100. In such embodiments, given that the lift spools 104, 106 of the disclosed lift station 100 are axially offset from one another within the housing 102, at least one of the outriggers 160, 162 may have an angled orientation as it extends outwardly from the housing 102 such that the distal ends 170, 174 of the outriggers 160, 162 are axially aligned with each other (e.g., by being disposed at the same or substantially the same axial location along the central axis 108 of the housing 102 and the rotational axes 136 of the lift spools 104, 106), thereby axially aligning the cords 42, 44 in the axial direction 194. Specifically, in several embodiments, the distal ends 170, 174 of the outriggers 160, 162 may generally be aligned along a common plane extending perpendicular to both the central axis 108 of the housing 102 and the rotational axes 136 of the lift spools 104, 106. For example, as shown in FIG. 5, in one embodiment, a cord entry/exit plane for the lift station 100 (e.g., such as that represented by plane 190 in FIG. 5 for the sake of simplicity and without intent to limit) extends through the cord entry/exit location 191 defined at the proximal end 172 of the second outrigger 162. In such an embodiment, the second outrigger 160 may, for example, be configured to extend outwardly from the housing 102 generally perpendicular to such axes 108, 136 (and generally parallel to the cord entry/exit plane 190) such that the second cord guide surface 178 is substantially aligned with the cord entry/exit plane 190 between the proximal and distal ends 172, 174 of the outrigger 162. Additionally, given that the cord entry/exit location 192 defined at the proximal end 168 of the first outrigger 160 is axially offset from the cord entry/exit plane 190 at which the distal ends 170, 174 of the outriggers 160, 162 are aligned (e.g., by an axial offset distance 193 along the axial direction 194 of the housing 102), the first outrigger 160 is configured to be angled relative to the cord entry/exit plane 190 as the first outrigger 160 extends outwardly from the housing 102 between its proximal and distal ends 168, 170. Specifically, as shown in FIG. 5 and as indicated above, to allow for proper winding and unwinding of the front lift cord 42, the proximal end 168 of the first outrigger 160 is generally positioned relative to the housing 102 such that the cord entry/exit location 192 for the first outrigger 160 is aligned with plane 198. In such an embodiment, to allow the distal end 170 of the first outrigger 160 to be aligned with the cord entry/exit plane 190 of the lift station 100 (and, thus, the distal end 174 of the second outrigger 162), the first outrigger 160 may extend outwardly from the housing 102 at a suitable outrigger angle 195 relative to the cord entry/exit plane 190. As such, the first cord guide surface 176 may generally be axially offset from and angled with respect to the cord entry/exit plane 190 as it extends between the proximal and distal ends 168, 170 of the first outrigger 160. It should be appreciated that, in general, the outrigger angle 195 may be selected based on the axial offset distance 193 of the cord wind/unwind location 192 for the first spool 104 and the associated length of the first outrigger 160 so as to position the distal end 170 of the first outrigger 160 at the location of the cord entry/exit plane 190 for the lift station 100.

It should also be appreciated that, as the axial location of the cord entry/exit plane 190 for the lift station 100 is varied (e.g., to accommodate differing configurations of the lift station 100 and/or associated covering 20), the orientation(s) of one or both of the outriggers 160, 162 may be similarly modified to ensure that the distal ends 170, 174 of both outriggers 160, 162 are generally positioned at the same axial location defined along the central axis 108 of the housing 102 and the rotational axes 136 of the lift spools 104, 106 (e.g., by being axially aligned with the cord entry/exit plane 190). For example, in one alternative embodiment, the cord entry/exit plane 190 may be aligned with the cord entry/exit location 192 for the first outrigger 160. In such an embodiment, the first outrigger 160 may, for example, be configured to extend outwardly from the housing 102 generally perpendicular to the housing/spool axes 108, 136 (and generally parallel to the cord entry/exit plane 190) between its proximal and distal ends 168, 170 while the second outrigger 162 may be angled from the cord entry/exit location 191 for the second outrigger 162 to the location of the cord entry/exit plane 190. In another embodiment, the cord entry/exit plane 190 may be axially offset from both of the cord entry/exit locations 192, 191 such that both outriggers 160, 162 define an angled orientation relative such plane 190. For instance, in one embodiment, the cord entry/exit plane 190 may be aligned with the central housing plane 142 (FIG. 5) defined at the center of the housing 102 between its first and second ends 110, 112. In such an embodiment, both outriggers 160, 162 may angled from their respective cord entry/exit locations 192, 191 towards the central plane 142 of the housing 102 to allow the distal ends 170, 174 of the outriggers 160, 162 to be aligned with the cord entry/exit plane 190.

Additionally, it should be appreciated that, in other embodiments of the present subject matter, the distal ends 170, 174 of the outriggers 160, 162 need not be aligned along a common plane, but, rather, may be axially offset from each other. For example, in one embodiment, any suitable axial offset distance may be defined between the distal ends 170, 174 of the outriggers 160, 162 along the axial direction 194 of the housing 102 that allows the outriggers 160, 162 to generally function as described herein.

As shown in FIGS. 5 and 6, in several embodiments, the first and second outriggers 160, 162 generally define varying radial lengths between their distal ends 170, 174 and the outer surface 114 of the housing 102. For example, the first outrigger 160 may define a first length 196 between its distal end 170 and the outer surface 114 of the housing 102 while the second outrigger 162 may define a second length 197 between its distal end 174 and the outer surface 114 of the housing 102, with the first length 196 being greater than the second length 197. As will be described below, the length of each outrigger 160, 162 may generally vary based on the relative positioning of the lift station 100 within the bottom rail 24 (e.g., in the fore-to-aft direction of the covering 20, as indicted by arrow 66 in FIGS. 1, 2, and 10. For instance, in the illustrated embodiment, the axes 108, 136 of the housing/spools 102, 104, 106 of the lift station 100 are configured to be disposed with the bottom rail 24 at a location closer to the rear side 50 of the covering 20, thereby necessitating the increased length 196 of the first outrigger 160 to allow the front lift cord 42 to be properly guided to the front side 48 of the covering 20 via the outrigger 160. However, in an embodiment in which the axes 108, 136 of the housing/spools 102, 104, 106 of the lift station 100 are configured to be centrally located within the bottom rail 24 (e.g., at a location equidistant from the front and rear sides 48, 50 of the covering 20), the lengths 196, 197 of the outriggers 160, 162 may be the same or substantially the same. Similarly, in an embodiment in which the axes 108, 136 of the housing/spools 102, 104, 106 of the lift station 100 are located within the bottom rail 24 closer to the front side 48 of the covering 20, the length 197 of the second outrigger 162 may be greater than the length 196 of the first outrigger 160.

Given that the lift spools 104, 106 are configured to be rotated along coaxially aligned axes 136 via the common lift rod 56, the outriggers 160, 162 may be configured to guide the lift cords 42, 44 to opposed sides of the spools 104, 106 such that both cords 42, 44 are simultaneously wound around the spools 104, 106 when the lift rod 56 is rotated in one direction and simultaneously unwound from the spools 104, 106 when the lift rod 56 is rotated in the opposite direction. For example, as particularly shown by the dashed lines in FIG. 9 indicating the path of the front lift cord 42 along the first outrigger 160, the first outrigger 160 is configured to guide the front lift cord 42 from the distal end 170 of the outrigger 160 to a top end 111 of the housing 102 for winding around its respective lift spool 104. In contrast, the second outrigger 162 is configured to guide the rear lift cord 44 from the distal end 174 of the outrigger 162 to a bottom end 113 of the housing 102 for winding around its respective lift spool 106. It should be appreciated that, based on the configuration of the illustrated lift station 100, the first outrigger 160 may be configured for guiding the front lift cord 42 to the top end 111 of the housing 102 given its increased length 196, thereby allowing for a larger radius of curvature of the associated guide surface 176 for reducing the loads on the lift cord 42.

Referring now to FIGS. 10-14, several views of the lift station 100 described above with reference to FIGS. 3-9 installed relative to the bottom rail 24 of the covering 20 described above with reference to FIGS. 1 and 2 are illustrated in accordance with aspects of the present subject matter.

Figure 10:
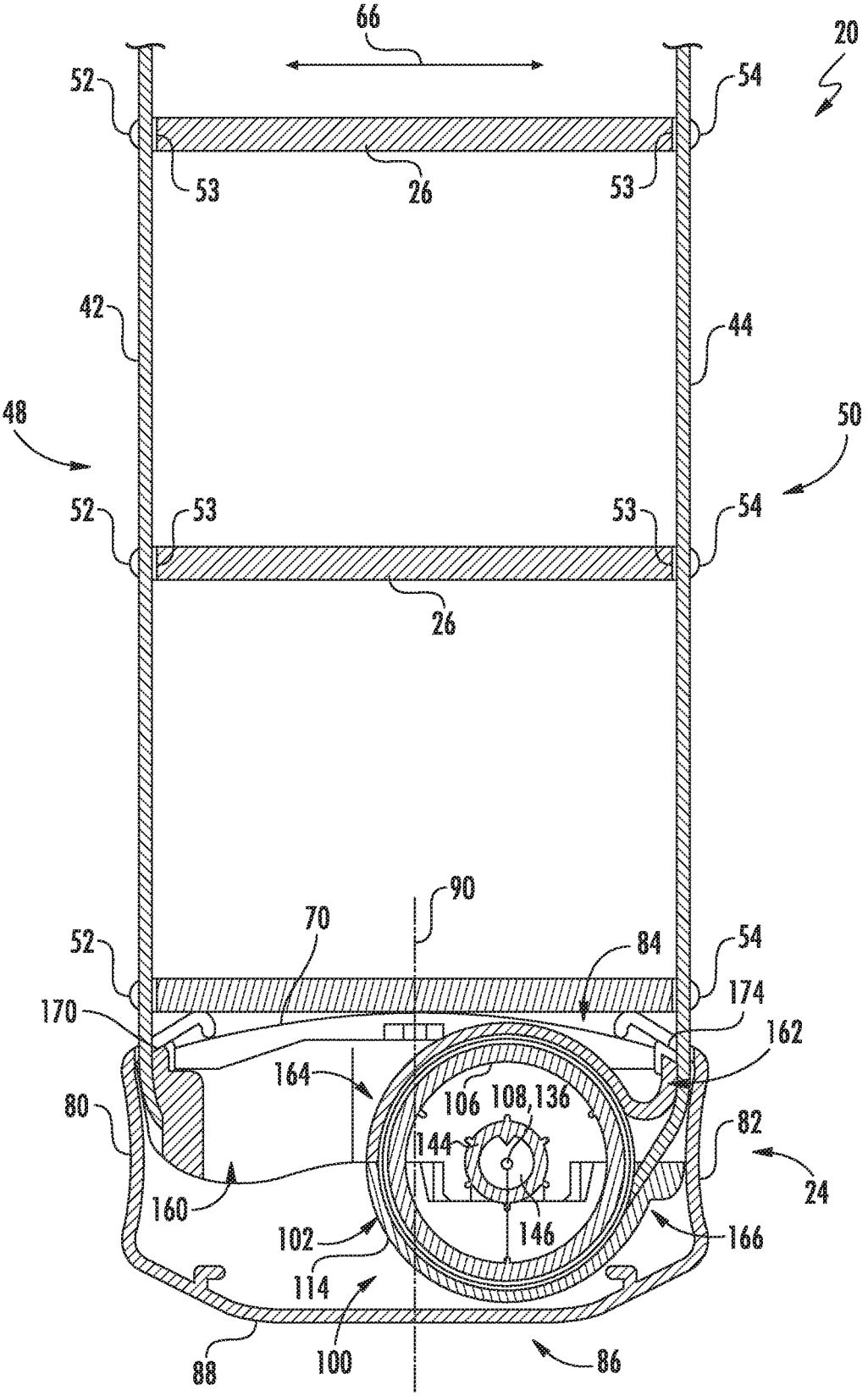
FIG. 10 illustrates a cross-sectional view of a portion of the covering shown in FIG. 1 taken about line X-X, particularly illustrating one embodiment of the disclosed lift station installed within the bottom rail of the covering in accordance with aspects of the present subject matter.

As particularly shown in FIG. 10, the bottom rail 24 generally includes front and rear walls 80, 82 extending generally vertically between top and bottom sides 84, 86 of the rail 24, with the front wall 80 extending along the front side 48 of the covering 20, and the rear wall 82 extending along the rear side 50 of the covering 20. Additionally, the bottom rail 24 includes a bottom wall 88 extending between the front and rear walls 80, 82 along the bottom side 86 of the rail 24. As shown in FIG. 10, a filler strip or cover strip 70 is also be installed between the front and rear walls 80, 82 of the bottom rail 24 such that the cover strip 90 extends generally adjacent to the top side 84 of the bottom rail 24. As is generally understood, the cover strip 70 may be installed relative to the bottom rail 24 during assembly of the covering 20 to cover the various internal components of the rail 24. In addition, one or more of the internal components of the bottom rail 24 may be coupled to the cover strip 70 to maintain the axial positioning of such component(s) within the rail 24. For instance, as indicated above, the lift station 100 may include mounting flanges 132 configured to receive suitable fasteners for securing the lift station 100 to the cover strip 70.

As shown in FIG. 10, the lift station 100 is generally configured to be installed within the bottom rail 24 between its front and rear walls 80, 82 such that the outriggers 160, 162 extend from the housing 102 to a location adjacent to such opposed walls 80, 82 of the rail 24. Specifically, the first outrigger 160 may be configured to extend outwardly from the outer surface 114 of the housing 102 such that the distal end 170 of the outrigger 160 is located adjacent to the front wall 80 of the bottom rail 24, thereby allowing the first outrigger 160 to guide the front lift cord 42 between the front side 48 of the covering 24 and the first lift spool 104 of the lift station 100. For example, as shown in FIG. 10, the distal end 170 of the first outrigger 160 is located directly adjacent to the front wall 80 of the bottom rail 24 such that the front lift cord 42 extends vertically from the distal end 170 of the first outrigger 160 along the front side 48 of the covering 20. However, in other embodiments, the distal end 170 of the first outrigger 160 may be spaced apart from the front wall 80 of the bottom rail 24 by a small distance depending on the desired positioning of the front lift cord 42 relative to the front wall 80 and/or the overall configuration of the bottom rail 24 (e.g., due to a larger bottom rail). Similarly, the second outrigger 162 may be configured to extend outwardly from the outer surface 114 of the housing 102 such that the distal end 174 of the outrigger 162 is located adjacent to the rear wall 82 of the bottom rail 24, thereby allowing the second outrigger 162 to guide the rear lift cord 44 from the rear side 50 of the covering 20 to the second lift spool 106 of the lift station 100. For example, as shown in FIG. 10, the distal end 174 of the second outrigger 162 is located directly adjacent to the rear wall 82 of the bottom rail 24 such that the rear lift cord 44 extends vertically from the distal end 174 of the second outrigger 162 along the rear side 50 of the covering 20. However, similar to the first outrigger 160, in other embodiments, the distal end 174 of the second outrigger 162 may be spaced apart from the rear wall 82 of the bottom rail 24 by a small distance depending on the desired positioning of the rear lift cord 44 relative to the rear wall 82 and/or the overall configuration of the bottom rail 24 (e.g., due to a larger bottom rail).

It should be appreciated that, in the illustrated embodiment, each slat 26 is shown in FIG. 10 as including grooves or notches 53 at its front and rear edges 52, 54 for receiving the front and rear lift cords 42, 44 as each cord 42, 44 extends vertically along its respective side 48, 50 of the covering 20. However, in other embodiments, the notches 53 defined at one or both of the edges 52, 54 of the slats 26 may be removed to enhance the privacy and lift-blocking functionality of the covering 20. For instance, in one embodiment, the notches 53 defined at the rear edges 54 of the slats 26 may be removed. In such an embodiment, the rear lift cord 44 may extend vertically between the headrail 22 and the bottom rail 24 along the rear edges 54 of the slats 26 without being received within any slot notches 53.

As shown in the illustrated embodiment, due to the specific arrangement of the bottom rail 24 and its internal components, the central/rotational axes 108, 136 of the housing/spools 102, 104, 106 of the lift station 100 (indicated by dot 108, 136 in FIG. 10) are offset from a central plane 90 of the bottom rail 24 defined between the front and rear walls 80, 82 in the fore-to-aft direction 66 of the cover 10, such as at a location closer to the rear wall 82 of the bottom rail 24. Thus, as indicated above, the lengths 196, 197 of the respective outriggers 160, 162 may differ to allow the front and rear lift cords 42, 44 to be properly guided by the outriggers 160, 162 to the front and rear sides 42, 44, respectively, of the covering 20. For instance, as shown in FIG. 10, given the increased distance from the outer surface 114 of the housing 102 to the front wall 80 of the rail 24, the length 196 of the first outrigger 160 is greater than the length 197 of the second outrigger 162. However, if the central/rotational axes 108, 136 of the housing/spools 102, 104, 106 of the lift station 100 were instead aligned with the central plane 90 of the bottom rail 24, the lengths 196, 197 of the outriggers 160, 162 may, for example, be the same or substantially the same.

Figure 12:
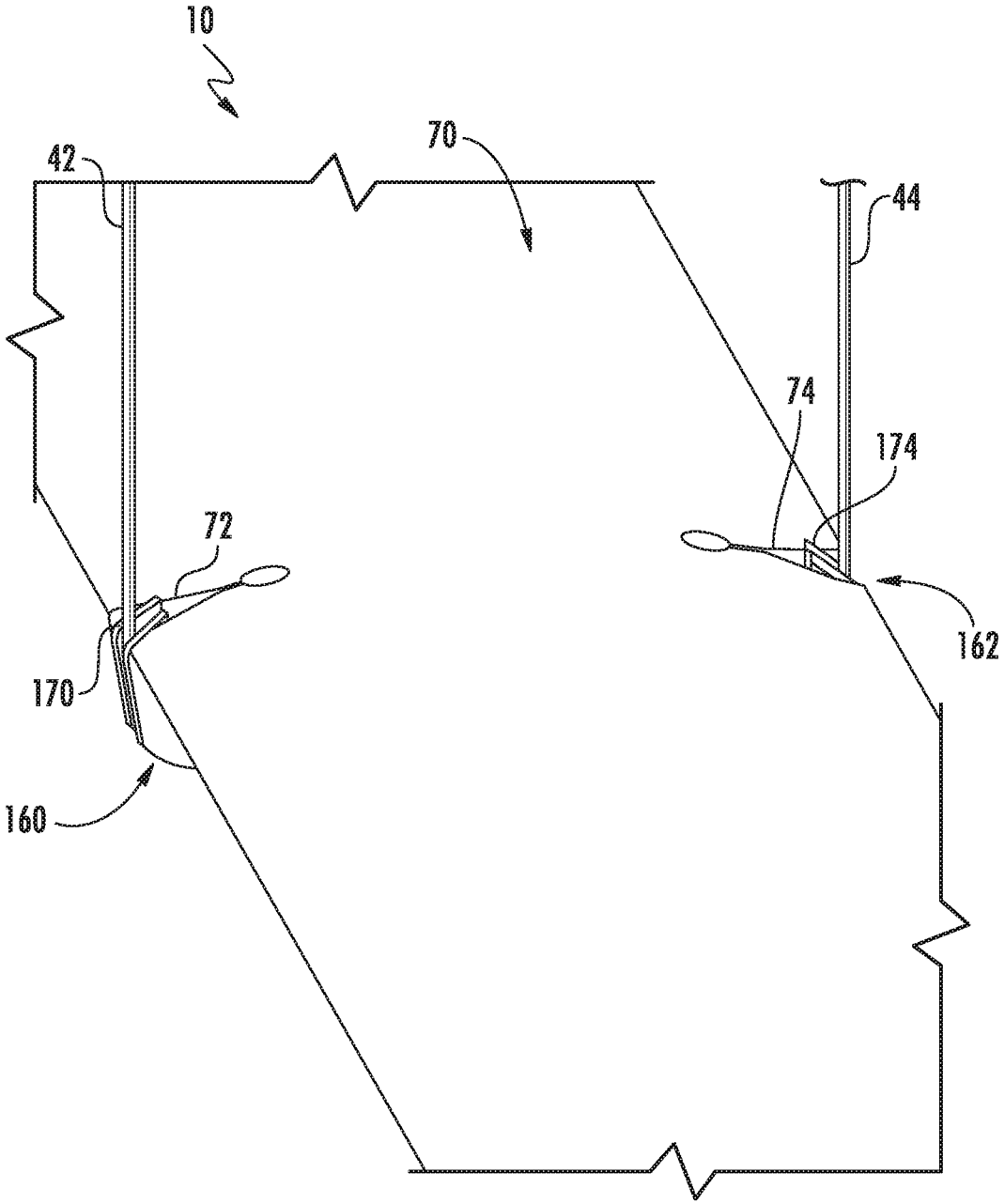
FIG. 12 illustrates a top perspective view of a cover strip of the covering shown in FIG. 10 with the bottom rail removed for purposes of illustration, particularly illustrating a portion of the disclosed lift station extending through portions of the cover strip.
Figure 13:
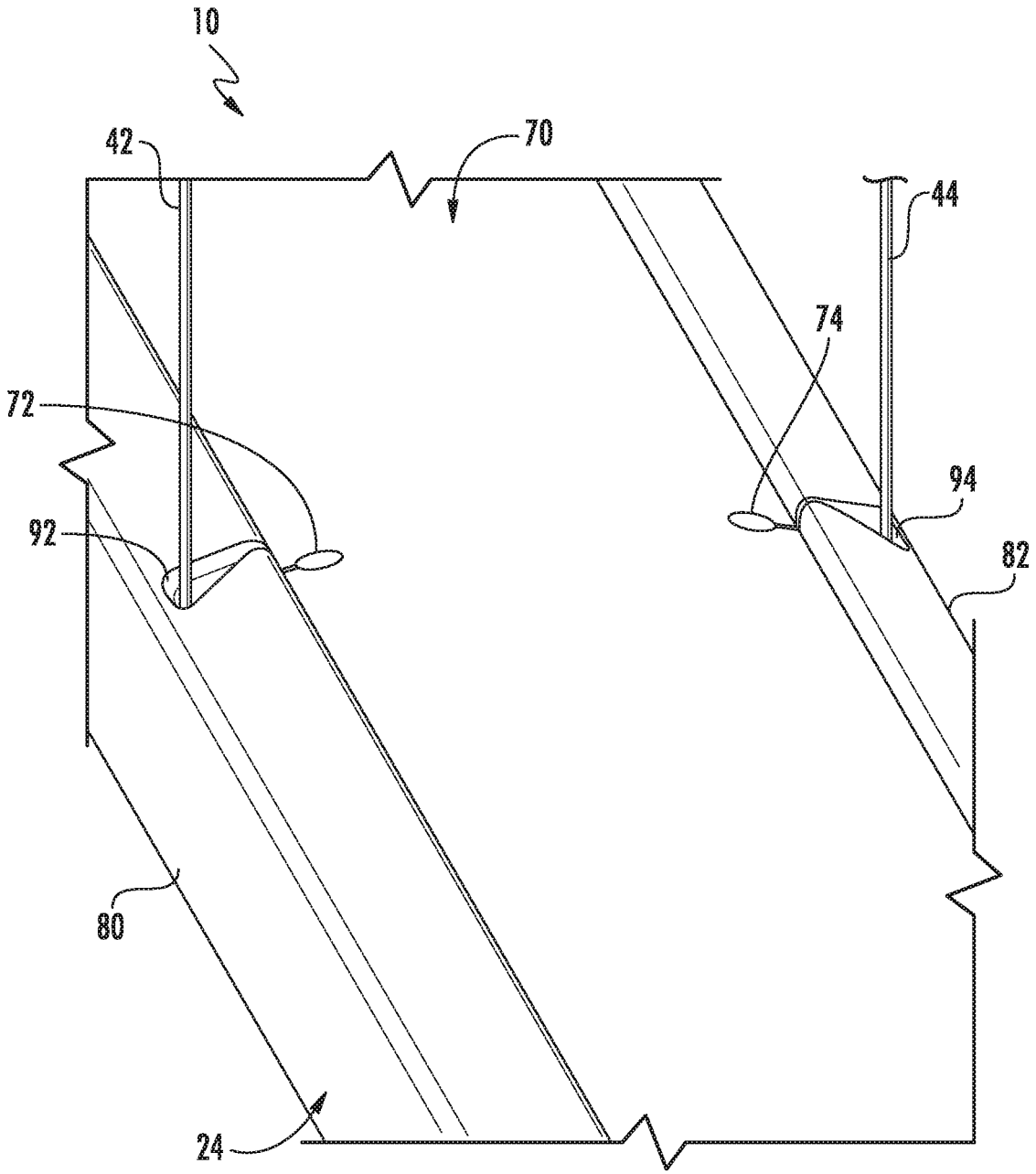
FIG. 13 illustrates the same top, perspective view of the cover strip shown in FIG. 12 with the bottom rail shown for purposes of illustration.
Figure 14:
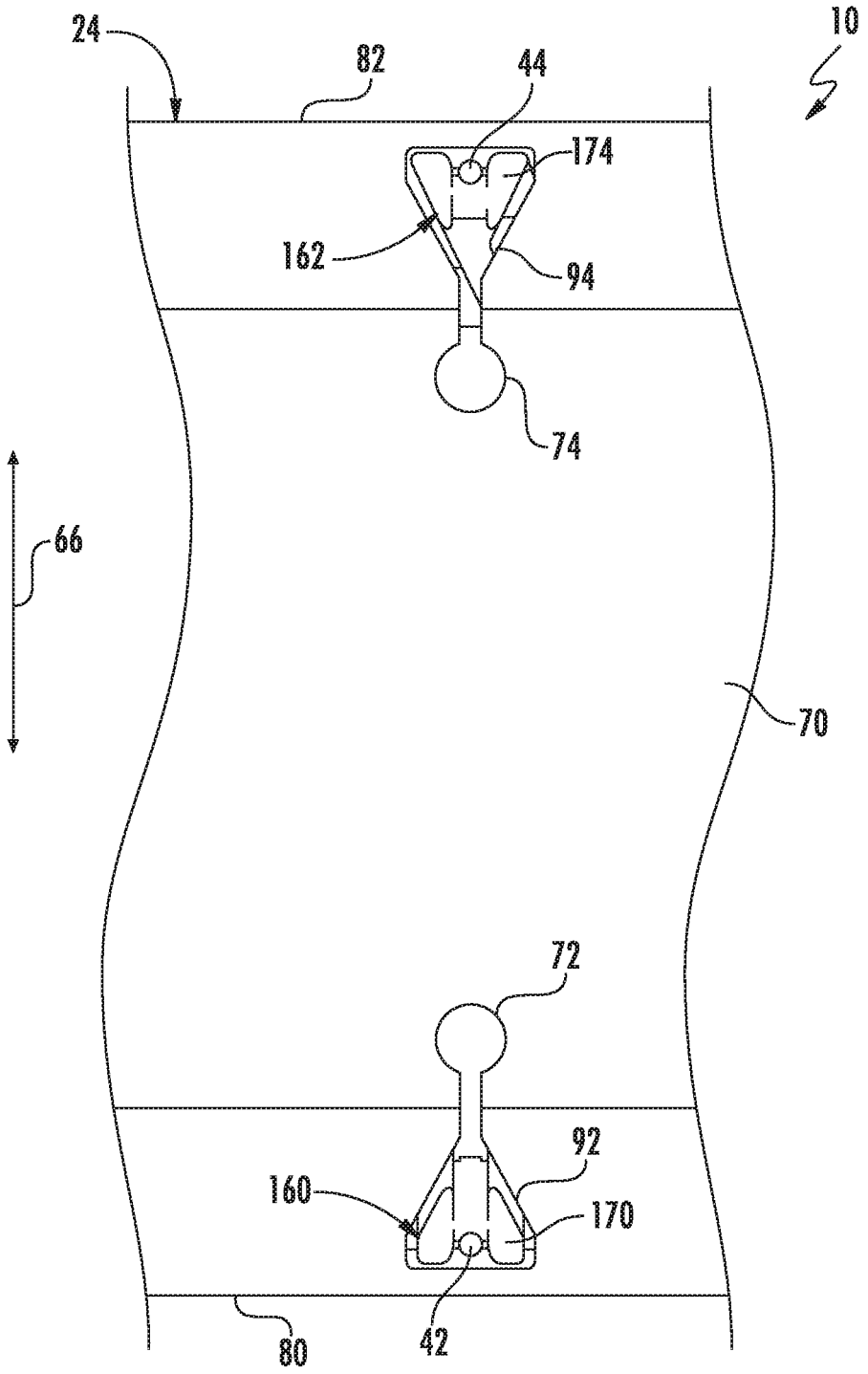
FIG. 14 illustrates a top view of the bottom rail and the cover strip shown in FIG. 13.

As particularly shown in FIGS. 12-14, in several embodiments, route slots are defined in both the bottom rail 24 and the cover strip 70 at locations adjacent to front and rear sides 48, 50 of the covering 20 to accommodate the lift cords 42, 44 and/or the distal ends 170, 174 of the outriggers 160, 162. For example, as shown in FIGS. 13 and 14, front and rear route slots 92, 94 are defined through the bottom rail 24 along its top side 84 at locations adjacent to the front and rear walls 80, 82, respectively, of the bottom rail 24. Similarly, as shown in FIGS. 12 and 14, front and rear route slots 72, 74 are similarly defined through the cover strip 70 at locations aligned with and/or adjacent to the route slots 92, 94 of the bottom rail 24. In such an embodiment, the front lift cord 42 passes through the front route slots 92, 72 of the bottom rail 24 and the cover strip 70 as the front lift cord 42 extends upwardly along the front side 48 of the covering 20, while the rear lift cord 44 passes through the rear route slots 94, 74 of the bottom rail 24 and the cover strip 70 as the rear lift cord 44 extends upwardly along the rear side 50 of the covering 20.

Figure 11:
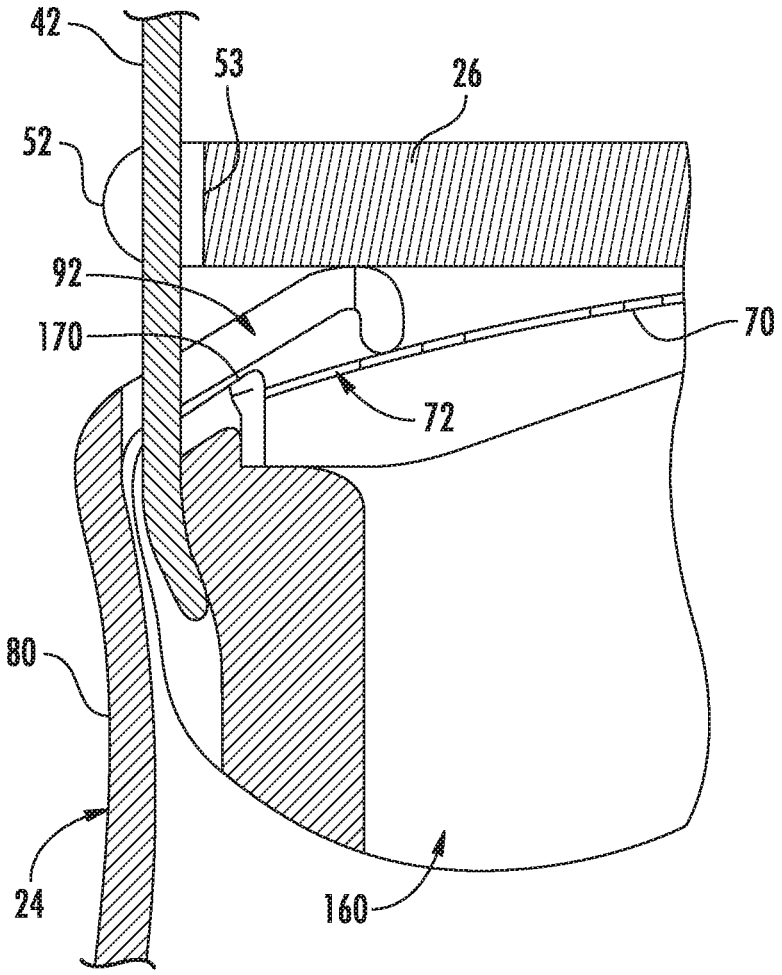
FIG. 11 illustrates an enlarged view of a portion of the cross-sectional view of the bottom rail and lift station shown in FIG. 10.

Additionally, in several embodiments, the route slots 72, 74 of the cover strip 70 and/or the route slots 92, 94 of the bottom rail 24 may be configured to receive distal portions of the outriggers 160, 162. For example, as shown in FIGS. 11 and 12, in one embodiment, portions of the first and second outriggers 160, 162 are configured to extend through the front and rear route slots 72, 74, respectively, of the cover strip 70 such that the distal end 170, 174 of each outrigger 160, 162 extends vertically beyond the cover strip 70 (e.g., as particularly shown in FIG. 11 with respect to the first outrigger 160). As a result, the distal end 170, 174 of each outrigger 160, 162 may serve to shield its associated lift cord 42, 44 from the cover strip 70, thereby preventing any potential damage that may occur to the lift cord 42, 44 due to wear as the lift cord 42, 44 is conveyed past the cover strip 70. Moreover, as shown in FIGS. 11 and 13, in the illustrated embodiment, the distal ends 170, 174 of the outriggers 160, 152 are recessed relative to the route slots 92, 94 of the bottom rail 24. However, in other embodiments, the outriggers 160, 162 may be configured to extend further outwardly such that the distal end 170, 174 of each outrigger 160, 162 is received within the adjacent route slot 92, 94 of the bottom rail 24.

While the foregoing Detailed Description and drawings represent various embodiments, it will be understood that various additions, modifications, and substitutions may be made therein without departing from the spirit and scope of the present subject matter. Each example is provided by way of explanation without intent to limit the broad concepts of the present subject matter. In particular, it will be clear to those skilled in the art that principles of the present disclosure may be embodied in other forms, structures, arrangements, proportions, and with other elements, materials, and components, without departing from the spirit or essential characteristics thereof. For instance, features illustrated or described as part of one embodiment can be used with another embodiment to yield a still further embodiment. Thus, it is intended that the present subject matter covers such modifications and variations as come within the scope of the appended claims and their equivalents. One skilled in the art will appreciate that the disclosure may be used with many modifications of structure, arrangement, proportions, materials, and components and otherwise, used in the practice of the disclosure, which are particularly adapted to specific environments and operative requirements without departing from the principles of the present subject matter. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the present subject matter being indicated by the appended claims, and not limited to the foregoing description.

In the foregoing Detailed Description, it will be appreciated that the phrases "at least one", "one or more", and "and/or", as used herein, are open-ended expressions that are both conjunctive and disjunctive in operation. The term "a" or "an" element, as used herein, refers to one or more of that element. As such, the terms "a" (or "an"), "one or more" and "at least one" can be used interchangeably herein. All directional references (e.g., proximal, distal, upper, lower, upward, downward, left, right, lateral, longitudinal, front, rear, top, bottom, above, below, vertical, horizontal, crosswise, radial, axial, clockwise, counterclockwise, and/or the like) are only used for identification purposes to aid the reader's understanding of the present subject matter, and/or serve to distinguish regions of the associated elements from one another, and do not limit the associated element, particularly as to the position, orientation, or use of the present subject matter. Connection references (e.g., attached, coupled, connected, joined, secured, mounted and/or the like) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

All apparatuses and methods disclosed herein are examples of apparatuses and/or methods implemented in accordance with one or more principles of the present subject matter. These examples are not the only way to implement these principles but are merely examples. Thus, references to elements or structures or features in the drawings must be appreciated as references to examples of embodiments of the present subject matter, and should not be understood as limiting the disclosure to the specific elements, structures, or features illustrated. Other examples of manners of implementing the disclosed principles will occur to a person of ordinary skill in the art upon reading this disclosure.

This written description uses examples to disclose the present subject matter, including the best mode, and also to enable any person skilled in the art to practice the present subject matter, including making and using any devices or systems and performing any incorporated methods. The patentable scope of the present subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

The following claims are hereby incorporated into this Detailed Description by this reference, with each claim standing on its own as a separate embodiment of the present disclosure. In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

What is claimed is:

1. A lift station configured for use with a covering for an architectural structure, said lift station comprising:

a housing defining a cavity therein and defining an outer surface along an exterior of said housing, said housing including a first side and a second side opposite said first side;

a first outrigger including a first proximal end positioned adjacent to said outer surface of said housing and a first distal end spaced apart from said outer surface of said housing, said first outrigger positioned on said first side of said housing, said first outrigger defining a first cord guide surface between said first proximal end and said first distal end that is configured to guide a first lift cord of the covering from said cavity to said first distal end of said first outrigger; and a second outrigger including a second proximal end positioned adjacent to said outer surface and a second distal end spaced apart from said outer surface, said second outrigger positioned on said second side of said housing opposite said first outrigger, said second outrigger defining a second cord guide surface between said second proximal end and said second distal end that is configured to guide a second lift cord of the covering from said cavity to said second distal end of said second outrigger.

2. The lift station of claim 1, wherein said first distal end of said first outrigger is aligned with said second distal end of said second outrigger along a common plane extending perpendicular to a central axis of said housing.

3. The lift station of claim 2, wherein said first proximal end of said first outrigger is offset from said common plane in an axial direction of said lift station extending parallel to said central axis of said housing.

4. The lift station of claim 3, wherein said first outrigger extends lengthwise from said outer surface of said housing between said first proximal end and said first distal end at an angle relative to said common plane such that said first distal end is aligned with said common plane in the axial direction of said lift station.

5. The lift station of claim 3, wherein said first cord guide surface is offset from said common plane in the axial direction of said lift station between said first proximal and distal ends of said first outrigger.

6. The lift station of claim 2, wherein said second proximal end of said second outrigger is aligned with said common plane in an axial direction of said lift station extending parallel to said central axis of said housing.

7. The lift station of claim 6, wherein said second outrigger extends lengthwise from said outer surface of said housing between said second proximal end and said second distal end substantially parallel to said common plane such that said second cord guide surface is substantially aligned with said common plane between said second proximal and distal ends of said second outrigger.

8. The lift station of claim 2, wherein:

said housing extends lengthwise between a first end of said housing and a second end of said housing and defines a central plane between said first and second ends that extends perpendicular to said central axis of said housing; and said central plane of said housing is offset from said common plane in an axial direction of said lift station extending parallel to said central axis of said housing.

9. The lift station of claim 1, wherein said first distal end of said first outrigger is axially offset from said second distal end of said second outrigger.

10. The lift station of claim 1, wherein:

a first guide channel formed at least partially by said first cord guide surface defines a first cord entry/exit location at said first proximal end of said first outrigger;

a second guide channel formed at least partially by said second cord guide surface defines a second cord entry/exit location at said second proximal end of second first outrigger; and said first cord entry/exit location is axially offset from said second cord entry/exit location in an axial direction of said lift station.

11. The lift station of claim 10, further comprising first and second lift spools positioned within said cavity;

wherein:

said first cord entry/exit location is aligned with a first plane extending perpendicular to a central axis of said housing and passing through a location at which the first lift cord contacts said first lift spool when the first lift cord is being wrapped around said first lift spool; and said second cord entry/exit location is aligned with a second plane extending perpendicular to said central axis of said housing and passing through a location at which the second lift cord contacts said second lift spool when the second lift cord is being wrapped around said second lift spool.

12. The lift station of claim 1, wherein:

said first outrigger defines a first length between said first proximal and distal ends along a direction extending perpendicular to a central axis of said housing;

said second outrigger defines a second length between said second proximal and distal ends along said direction; and said first length is greater than said second length.

13. The lift station of claim 1, further comprising at least one lift spool positioned within said cavity, the first and second lift cords configured to wind around and unwind from said at least one lift spool.

14. The lift station of claim 13, wherein:

said at least one lift spool comprises a first lift spool and a second lift spool positioned within said cavity;

said first cord guide is configured to guide the first lift cord from said first lift spool to said first distal end of said first outrigger; and said second cord guide is configured to guide the second lift cord from said second lift spool to said second distal end of said second outrigger.

15. The lift station of claim 14, wherein said first and second lift spools are coaxially aligned within said housing for rotation about a common rotational axis.

16. A covering for an architectural structure, comprising:

a head rail;

a bottom rail spaced apart from said head rail;

at least one covering element supported between said head rail and said bottom rail;

a first lift cord extending between said head rail and said bottom rail along a front side of said covering;

a second lift cord extending between said head rail and said bottom rail along a rear side of said covering; and a lift station positioned within said bottom rail, said lift station comprising:

a housing defining a cavity therein, said housing defining an outer surface along an exterior of the housing;

a first outrigger including a first proximal end positioned adjacent to said outer surface of said housing and a first distal end spaced apart from said outer surface of said housing, said first outrigger extending outwardly from said housing toward said front side of said covering, said first outrigger defining a first cord guide surface between said first proximal end and said first distal end for guiding said first lift cord to said front side of said covering; and a second outrigger including a second proximal end positioned adjacent to said outer surface and a second distal end spaced apart from said outer surface, said second outrigger extending outwardly from said housing toward said rear side of said covering, said second outrigger defining a second cord guide surface between said second proximal end and said second distal end for guiding said second lift cord to said rear side of said covering.

17. A covering for an architectural structure, comprising:

a head rail;

a bottom rail spaced apart from said head rail;

at least one covering element supported between said head rail and said bottom rail;

a first lift cord extending between said head rail and said bottom rail along a front side of said covering;

a second lift cord extending between said head rail and said bottom rail along a rear side of said covering; and a lift station positioned within said bottom rail, said lift station comprising:

a housing defining a spool cavity therein, said housing defining an outer surface along an exterior of the housing;

a first lift spool rotatable within said spool cavity to allow said first lift cord to be wound around and unwound from said first lift spool;

a second lift spool rotatable within said spool cavity to allow said second lift cord to be wound around and unwound from said second lift spool;

a first outrigger including a first proximal end positioned adjacent to said outer surface of said housing and a first distal end spaced apart from said outer surface of said housing, said first outrigger extending outwardly from said housing toward said front side of said covering, said first outrigger defining a first cord guide surface between said first proximal end and said first distal end for guiding said first lift cord from said first lift spool to said front side of said covering; and a second outrigger including a second proximal end positioned adjacent to said outer surface of said housing and a second distal end spaced apart from said outer surface of said housing, said second outrigger extending outwardly from said housing toward said rear side of said covering, said second outrigger defining a second cord guide surface between said second proximal end and said second distal end for guiding said second lift cord from said second lift spool to said rear side of said covering.

18. The covering of claim 17, wherein:

said bottom rail includes a first wall positioned along said front side of said covering and a second wall positioned along said rear side of said covering; and said housing is positioned between said first and second walls of said bottom rail such that said outer surface of said housing is spaced apart from both of said first and second walls of said bottom rail.

19. The covering of claim 18, wherein:

said bottom rail defines a central plane between said first and second walls; and a central axis of said housing is offset from said central plane such that said central axis is located closer to one of said first wall or said second wall of said bottom rail than the other of said first wall or said second wall of said bottom rail.

20. The covering of claim 18, further comprising a cover strip extending between said first and second walls along a top side of said bottom rail, said cover strip defining first and second route slots;

wherein a portion of said first outrigger extends through said first route slot and a portion of said second outrigger extends through said second route slot.

* * * * *